US005861869A

United States Patent [19]

Scheffer et al.

[11] Patent Number: 5,861,869

[45] Date of Patent: Jan. 19, 1999

[54] GRAY LEVEL ADDRESSING FOR LCDS

[75] Inventors: Terry J. Scheffer, Portland; Arlie R. Conner, Tualatin; Benjamin R. Clifton, Oregon City; Dennis W. Prince, Banks, all of Oreg.

[73] Assignee: In Focus Systems, Inc., Wilsonville, Oreg.

[21] Appl. No.: 444,652

[22] Filed: May 19, 1995

Related U.S. Application Data

[63] Continuation-in-part of Ser. No. 883,002, May 14, 1992, Pat. No. 5,459,495, and a continuation-in-part of Ser. No. 77,859, Jun. 16, 1993, Pat. No. 5,473,338.

[51] Int. Cl.[6] ..... G09G 5/10

[52] U.S. Cl. ..... 345/147; 345/89

[58] Field of Search ..... 345/147, 87, 100, 345/89, 90, 94

[56] References Cited

U.S. PATENT DOCUMENTS

| | | | |
|---|---|---|---|
| 3,955,187 | 5/1976 | Bigelow | 340/324 M |
| 3,997,719 | 12/1976 | Judice | 178/7.3 D |
| 4,043,640 | 8/1977 | Berreman | 350/160 LC |
| 4,427,978 | 1/1984 | Williams | 340/784 |
| 4,485,380 | 11/1984 | Soneda et al. | 340/784 |
| 4,508,427 | 4/1985 | Ross | 350/335 |
| 4,560,982 | 12/1985 | Sonehara et al. | 340/784 |
| 4,709,995 | 12/1987 | Kuribayashi et al. | 350/350 S |
| 4,743,096 | 5/1988 | Wakai et al. | 350/333 |
| 4,746,197 | 5/1988 | Endo et al. | 350/333 |
| 4,752,774 | 6/1988 | Clerc et al. | 340/784 |
| 4,766,430 | 8/1988 | Gillette et al. | 340/793 |
| 4,769,713 | 9/1988 | Yasui | 358/236 |
| 4,808,991 | 2/1989 | Tachiuchi et al. | 340/793 |
| 4,818,078 | 4/1989 | Mouri et al. | 350/350 S |
| 4,840,460 | 6/1989 | Bernot et al. | 350/333 |
| 4,840,462 | 6/1989 | Hartmann | 350/350 S |
| 4,845,482 | 7/1989 | Howard et al. | 340/805 |

(List continued on next page.)

OTHER PUBLICATIONS

Yoshio Suzuki, Mitsunobu Sekiya, Kunihiko Arai and Akio Ohkoshi, "A Liquid–Crystal Image Display," SID 83 Digest, 32–33.

Sprokel, Gerald J., "The Physics and Chemistry of Liquid Crystal Devices," pp. 105–113, 1980.

Hideaki Kawakami, Hisao Hanmura and Eiji Kaneko, "Brightness Uniformity in Liquid Crystal Displays," SID 80 Digest, 28–29.

T.J. Scheffer et al. "Active Addressing of STN Displays for High Performance Video Applications," Displays, vol. 14, No. 2, Apr. 1993, Oxford (UK) pp. 74–85.

Celi et al., "A Video Controller for a Liquid Crystal Alphanumeric Panel," *Alta Frequenza*, vol. LI, No. 3 (May–Jun. 1982), pp. 152–158.

(List continued on next page.)

*Primary Examiner*—Amare Mengistu
*Attorney, Agent, or Firm*—Stoel Rives LLP

[57] ABSTRACT

Method and apparatus for providing gray level addressing for passive liquid crystal display (LCD) panels having overlapping row and column electrodes defining pixels are disclosed. Depending upon whether the rows are being addressed by "standard" or "Swift" addressing, the signals for applying to the column electrodes are determined by different calculations, in all of which modes the amplitudes of the column signals are related to the gray level desired to be displayed by the individual pixels. For a split interval system, column signals of appropriate amplitude and polarity are applied during different subintervals of a characteristic time interval of the display panel depending upon the method of addressing the rows. In the full interval mode, the column signals applied over a full time interval are based on the desired gray level of all the pixels in the column, adjusted to provide the proper rms voltage across all the pixels so that they display the desired gray levels. The adjustment can be spread across multiple addressing intervals and can be added into the column signal when rows are selected or can be applied to the column electrode when no row is selected.

22 Claims, 26 Drawing Sheets

U.S. PATENT DOCUMENTS

| | | | |
|---|---|---|---|
| 4,892,389 | 1/1990 | Kuijk | 350/333 |
| 4,893,175 | 1/1990 | Fukada | 358/12 |
| 4,945,352 | 7/1990 | Ejiri | 340/805 |
| 4,991,022 | 2/1991 | Canfield et al. | 345/121 |
| 5,010,327 | 4/1991 | Wakita et al. | 345/87 |
| 5,055,833 | 10/1991 | Wehlen | 340/805 |
| 5,062,001 | 10/1991 | Farwell et al. | 358/236 |
| 5,134,495 | 7/1992 | Frazier | 358/298 |
| 5,189,406 | 2/1993 | Humphries et al. | 340/793 |
| 5,214,417 | 5/1993 | Yamazaki | 340/784 |
| 5,280,280 | 1/1994 | Hotto | 345/94 |
| 5,298,914 | 3/1994 | Yamazaki | 345/103 |
| 5,301,047 | 4/1994 | Hoshino et al. | 359/55 |
| 5,315,315 | 5/1994 | Nakamura | 345/208 |
| 5,420,604 | 5/1995 | Scheffer et al. | 345/100 |
| 5,548,302 | 8/1996 | Kuwata et al. | 345/89 |
| 5,594,466 | 1/1997 | Yamamoto et al. | 345/100 |

OTHER PUBLICATIONS

W.E. Howard et al., "Eliminating Crosstalk in Thin Film Transistor/Liquid Crystal Displays," Conference Record of the 1988 International Display Research Conference, pp. 230–235.

M.J. Powell et al., "A6–in. Full–Color Liquid–Crystal Television Using An Active Matrix of Amorphous–Silicon TFTs," Proceedings of the SID, vol. 29/3 1988, pp. 227–232.

J.R. Hughes, "Contrast Variations in High–level Multiplexed Twisted Nematic Liquid–Crystal Displays," IEEE Proceedings, vol. 133, Pt. I, No. 4, Aug. 1986, pp. 145–151.

M. Akatsuka et al., "Material Approach for the Reduction of Crosstalk in Simple Matrix LCDs," IEEE Aug. 1991, pp. 64–67.

Y. Kaneko et al., "Crosstalk–Free Driving Methods for STN–LCDs," Proceedings of the SID, vol. 31/4 1990, pp. 333–336.

H. Hirai et al., "A New Driving Method for Crosstalk Compensation in Simple–Matrix LCDs," Japan Display '92, pp. 499–502.

S. Nishitani, et al., "New Drive Method for Eliminate Crosstalk in STN–LCDs" SID '93 Digest, pp. 97–100.

Ruckmongathan, "A Generalized Addressing Technique for RMS Responding Matrix LCDs," 1988 IDRC, pp. 80–85.

Lagerwall, "Ferroelectric Liquid Crystal for Displays," 1985 IDRC, pp. 213–221.

FIG. 3A (Prior Art)
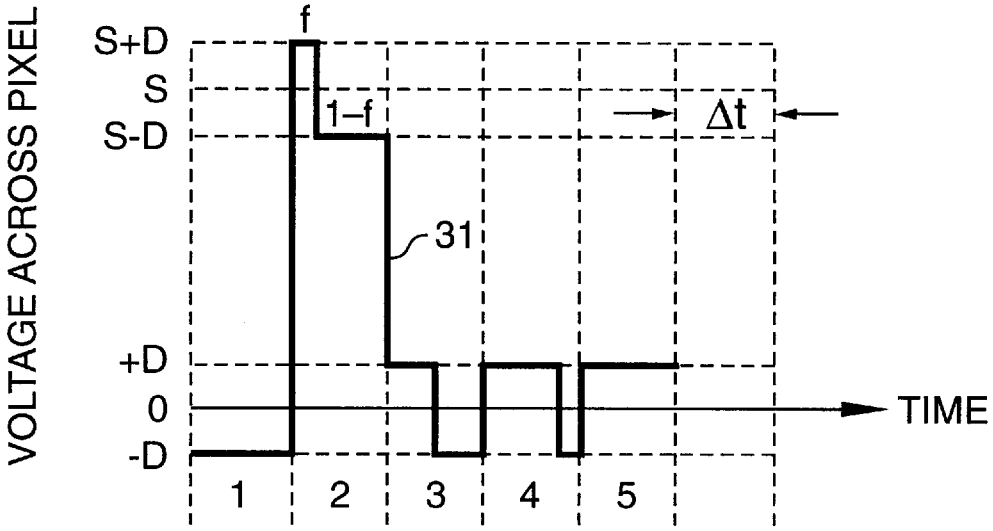
FIG. 3B This Invention
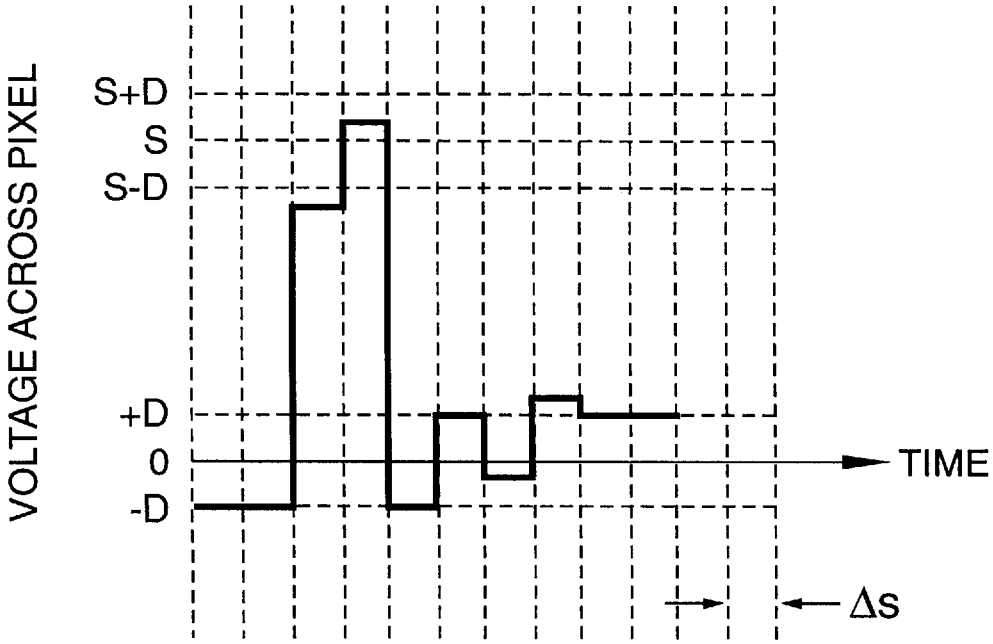

FIG. 5A (Prior Art)
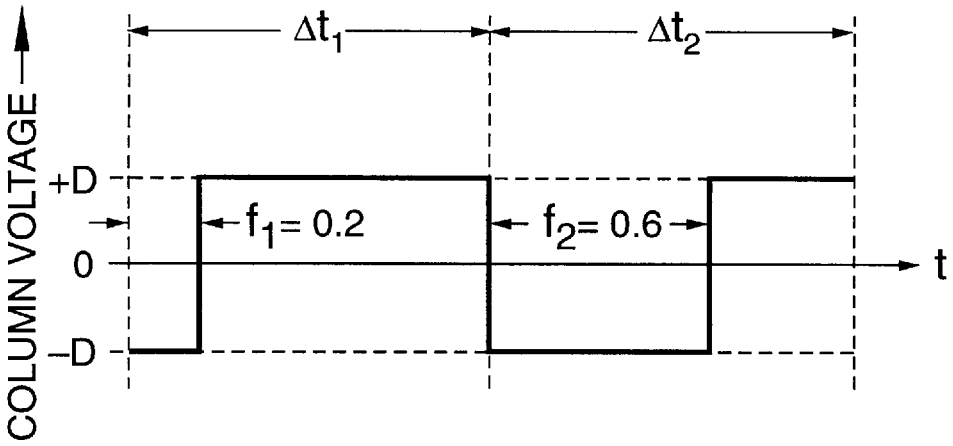
FIG. 5B This Invention
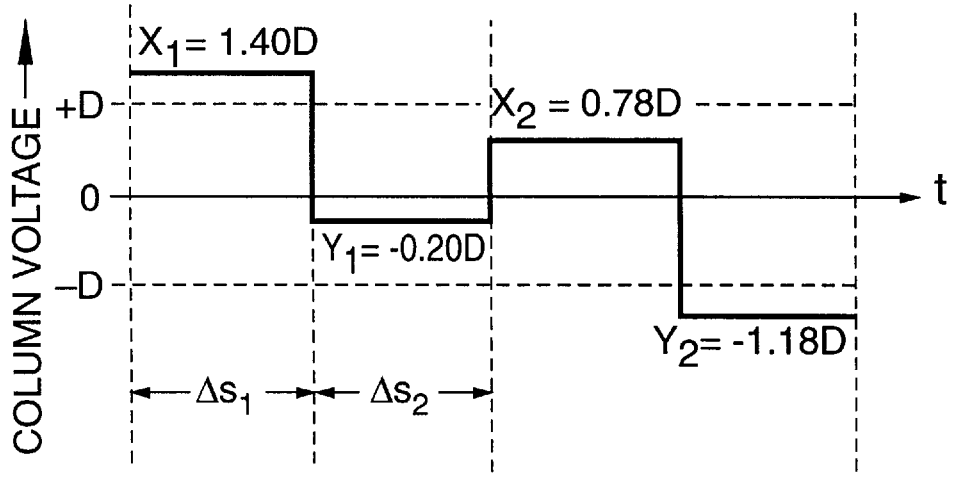

FRAME PERIOD
1 (1) 2 (5) 3 (2) 4 (6) 5 (3) 6 (7) 7 (4) 8 (8) 9 (9)
ROW NO.
ROW SIGNALS
$F_{1-7}$
+D
0
−D
212
COLUMN SIGNALS
$G_1(\Delta t)$
$G_2(\Delta t)$
+2D
-D
-2D
COLUMN SIGNAL FOR COLUMN 1
COLUMN SIGNAL FOR COLUMN 2
-1
-1/2
+1/2
+1
0
1.871
1.732
12
31
32
34
36₁
36₂
36₃
36₄
36₅
37
39
41
42
210

FRAME PERIOD
1 (1) 2 (5) 3 (2) 4 (6) 5 (3) 6 (7) 7 (4) 8 (8) 9 (9)
ROW NO.
1(1)
2(4)
3(2)
4(5)
5(3)
6(6)
7(7)
ROW SIGNALS
$F_{1-7}$
+D
0
−D
+2D
-D
-2D
COLUMN SIGNALS
$G_1(\Delta t)$
$G_2(\Delta t)$
COLUMN SIGNAL FOR COLUMN 1
COLUMN SIGNAL FOR COLUMN 2
-1
-1/2
+1/2
+1
0
1.871
1.732
12
31
32
34
36
37
39
41
42

FRAME PERIOD
1 (1) 2 (5) 3 (2) 4 (6) 5 6 (3) 7 (7) 8 (4) 9 (8) 10
ROW SIGNALS
+D
0
–D
$F_{1-7}$
ROW NO.
1(1)
2(4)
3(2)
4(5)
5(3)
6(6)
7(7)
COLUMN SIGNALS
+2D
$G_1(\Delta t)$
- D
-2D
$G_2(\Delta t)$
COLUMN SIGNAL FOR COLUMN 1
COLUMN SIGNAL FOR COLUMN 2

34
12
-1
-1/2
+1
0
+1/2
1.871
1.732
$36_1$
$36_2$
$36_3$
$36_4$
$36_5$
41
32
31
42
39
37

FRAME PERIOD
1 2 3 4 5 6 7 8 9 10
ROW SIGNALS
+D
0
–D
COLUMN SIGNALS
+2D
+D
$G_1(\Delta t)$ 0
- D
-2D
$G_2(\Delta t)$ 0
-D
-2D
COLUMN SIGNAL FOR COLUMN 1
COLUMN SIGNAL FOR COLUMN 2
34
12
$36_1$
41
-1
-1/2
+1
$36_2$
32
0
42
1.323
1.0
$36_3$
+1/2
$36_4$
$36_5$
31
39
37
1.414

FRAME PERIOD
1 2 3 4 5 6 7 8 9 10
(1) (5) (2) (6) (3) (7) (4) (8)
ROW NO.
1(1)
2(4)
3(2)
4(5)
5(3)
6(6)
7(7)
ROW SIGNALS
+D
0
−D
$F_{1-7}$
COLUMN SIGNALS
+2D
$G_1(\Delta t)$
$G_2(\Delta t)$
-D
-2D
COLUMN SIGNAL FOR COLUMN 1
COLUMN SIGNAL FOR COLUMN 2
12
34
41
32
$36_1$
$36_2$
$36_3$
$36_4$
$36_5$
31
42
39
37
-1
-1/2
+1
0
+1/2
1.871
1.732

FIG. 26

| EXAMPLE OF 240 LINE DISPLAY DRIVEN 7 LINES AT A TIME WITH 32 (NS) TIME INTERVALS | | | | | | | | |
|---|---|---|---|---|---|---|---|---|
| | SUB-FRAME 1 | SUB-FRAME 2 | SUB-FRAME 3 | SUB-FRAME 4 | SUB-FRAME 5 | SUB-FRAME 6 | SUB-FRAME 7 | SUB-FRAME 8 |
| INTERVAL 1 | NS 1 | RSS 1 | RSS 1 | RSS 1 | RSS 1 | RSS 1 | RSS 1 | RSS 1 |
| INTERVAL 2 | RSS 1 | NS 5 | RSS 2 | RSS 2 | RSS 2 | RSS 2 | RSS 2 | RSS 2 |
| INTERVAL 3 | RSS 2 | RSS 2 | NS 9 | RSS 3 | RSS 3 | RSS 3 | RSS 3 | RSS 3 |
| INTERVAL 4 | RSS 3 | RSS 3 | RSS 3 | NS 13 | RSS 4 | RSS 4 | RSS 4 | RSS 4 |
| INTERVAL 5 | RSS 4 | RSS 4 | RSS 4 | RSS 4 | NS 17 | RSS 5 | RSS 5 | RSS 5 |
| INTERVAL 6 | RSS 5 | RSS 5 | RSS 5 | RSS 5 | RSS 5 | NS 21 | RSS 6 | RSS 6 |
| INTERVAL 7 | RSS 6 | RSS 6 | RSS 6 | RSS 6 | RSS 6 | RSS 6 | NS 25 | RSS 7 |
| INTERVAL 8 | RSS 7 | RSS 7 | RSS 7 | RSS 7 | RSS 7 | RSS 7 | RSS 7 | NS 29 |
| INTERVAL 9 | RSS 8 | RSS 8 | RSS 8 | RSS 8 | RSS 8 | RSS 8 | RSS 8 | RSS 8 |
| INTERVAL 10 | RSS 9 | RSS 9 | RSS 9 | RSS 9 | RSS 9 | RSS 9 | RSS 9 | RSS 9 |
| INTERVAL 11 | NS 2 | RSS 10 | RSS 10 | RSS 10 | RSS 10 | RSS 10 | RSS 10 | RSS 10 |
| INTERVAL 12 | RSS 10 | NS 6 | RSS 11 | RSS 11 | RSS 11 | RSS 11 | RSS 11 | RSS 11 |
| INTERVAL 13 | RSS 11 | RSS 11 | NS 10 | RSS 12 | RSS 12 | RSS 12 | RSS 12 | RSS 12 |
| INTERVAL 14 | RSS 12 | RSS 12 | RSS 12 | NS 14 | RSS 13 | RSS 13 | RSS 13 | RSS 13 |
| INTERVAL 15 | RSS 13 | RSS 13 | RSS 13 | RSS 13 | NS 18 | RSS 14 | RSS 14 | RSS 14 |
| INTERVAL 16 | RSS 14 | RSS 14 | RSS 14 | RSS 14 | RSS 14 | NS 22 | RSS 15 | RSS 15 |
| INTERVAL 17 | RSS 15 | RSS 15 | RSS 15 | RSS 15 | RSS 15 | RSS 15 | NS 26 | RSS 16 |
| INTERVAL 18 | RSS 16 | RSS 16 | RSS 16 | RSS 16 | RSS 16 | RSS 16 | RSS 16 | NS 30 |
| INTERVAL 19 | RSS 17 | RSS 17 | RSS 17 | RSS 17 | RSS 17 | RSS 17 | RSS 17 | RSS 17 |
| INTERVAL 20 | RSS 18 | RSS 18 | RSS 18 | RSS 18 | RSS 18 | RSS 18 | RSS 18 | RSS 18 |
| INTERVAL 21 | NS 3 | RSS 19 | RSS 19 | RSS 19 | RSS 19 | RSS 19 | RSS 19 | RSS 19 |
| INTERVAL 22 | RSS 19 | NS 7 | RSS 20 | RSS 20 | RSS 20 | RSS 20 | RSS 20 | RSS 20 |
| INTERVAL 23 | RSS 20 | RSS 20 | NS 11 | RSS 21 | RSS 21 | RSS 21 | RSS 21 | RSS 21 |
| INTERVAL 24 | RSS 21 | RSS 21 | RSS 21 | NS 15 | RSS 22 | RSS 22 | RSS 22 | RSS 22 |
| INTERVAL 25 | RSS 22 | RSS 22 | RSS 22 | RSS 22 | NS 19 | RSS 23 | RSS 23 | RSS 23 |
| INTERVAL 26 | RSS 23 | RSS 23 | RSS 23 | RSS 23 | RSS 23 | NS 23 | RSS 24 | RSS 24 |
| INTERVAL 27 | RSS 24 | RSS 24 | RSS 24 | RSS 24 | RSS 24 | RSS 24 | NS 27 | RSS 25 |
| INTERVAL 28 | RSS 25 | RSS 25 | RSS 25 | RSS 25 | RSS 25 | RSS 25 | RSS 25 | NS 31 |
| INTERVAL 29 | RSS 26 | RSS 26 | RSS 26 | RSS 26 | RSS 26 | RSS 26 | RSS 26 | RSS 26 |
| INTERVAL 30 | RSS 27 | RSS 27 | RSS 27 | RSS 27 | RSS 27 | RSS 27 | RSS 27 | RSS 27 |
| INTERVAL 31 | NS 4 | RSS 28 | RSS 28 | RSS 28 | RSS 28 | RSS 28 | RSS 28 | RSS 28 |
| INTERVAL 32 | RSS 28 | NS 8 | RSS 29 | RSS 29 | RSS 29 | RSS 29 | RSS 29 | RSS 29 |
| INTERVAL 33 | RSS 29 | RSS 29 | NS 12 | RSS 30 | RSS 30 | RSS 30 | RSS 30 | RSS 30 |
| INTERVAL 34 | RSS 30 | RSS 30 | RSS 30 | NS 16 | RSS 31 | RSS 31 | RSS 31 | RSS 31 |
| INTERVAL 35 | RSS 31 | RSS 31 | RSS 31 | RSS 31 | NS 20 | RSS 32 | RSS 32 | RSS 32 |
| INTERVAL 36 | RSS 32 | RSS 32 | RSS 32 | RSS 32 | RSS 32 | NS 24 | RSS 33 | RSS 33 |
| INTERVAL 37 | RSS 33 | RSS 33 | RSS 33 | RSS 33 | RSS 33 | RSS 33 | NS 28 | RSS 34 |
| INTERVAL 38 | RSS 34 | RSS 34 | RSS 34 | RSS 34 | RSS 34 | RSS 34 | RSS 34 | NS 32 |
| INTERVAL 39 | RSS 35 | RSS 35 | RSS 35 | RSS 35 | RSS 35 | RSS 35 | RSS 35 | RSS 35 |

RSS = ROW SELECT SIGNAL
NS = NON-SELECT

GRAY LEVEL ADDRESSING FOR LCDS

This application is a continuation-in-part of U.S. patent application Ser. No. 07/883,002 filed May 14, 1992, U.S. Pat. No. 5,459,495, and of U.S. patent application Ser. No. 08/077,859, filed Jun. 16, 1993, U.S. Pat. No. 5,473,338.

BACKGROUND OF THE INVENTION

1. Field of the Invention

This invention relates to addressing liquid crystal displays (LCDs) to provide a plurality of gray shades or levels for the displayed image and more particularly to an apparatus and a method for providing a very high number of gray levels for a fast-responding passive matrix LCD.

LCDs are becoming increasingly useful for displaying images not only in projection systems but as screens for television receivers and computers. As a consequence, there is a demand for even faster-responding, high information content LCDs that can provide a very large number of gray levels between white and black or a large color palette.

2. Discussion of the Prior Art

One method of providing gray scale for an LCD is known as frame modulation, exemplified by U.S. Pat. Nos. 4,752,744 and 5,062,001 and an article by Y. Suzuki, et al., "A Liquid-Crystal Image Display," 1983 *SID Digest of Technical Papers* XIV 32–33 (1983). In these frame modulated systems the pixels forming the image on the screen are turned "on" and "off" in different frames correlated to the gray level or shade of color desired. When applied to faster-responding LCDs, however, frame modulation causes "flicker" and "swim." The former is perceived by the viewer as if the image were being rapidly turned on and off, and in the latter, the image appears to have ripples or waves passing through it.

The so-called "pulse-width modulation" gray scale system, exemplified by U.S. Pat. No. 4,427,978 issued Jan. 24, 1984 and an article by H. Kawakami, et al., "Brightness Uniformity in Liquid Crystal Displays," 1980 *SID Direst of Technical Papers XXI*, 28–29 (1980), is limited in the number of distinct gray levels that it can produce. Pulse-width modulation is physically incapable of providing a number of gray levels on the order of 256 which is desirable to bring out the fine detail of images required in "multimedia" applications of LCDs. In pulse-width modulated systems, the pulses become narrower and the high frequency content of the drive signals increases with the number of gray levels. These higher frequencies are cut off by the low-pass RC filter action of the LCD panel, which makes it difficult to realize more than about 4 to 7 gray levels on the display.

SUMMARY OF THE INVENTION

It is therefore an object of this invention to overcome the difficulties of prior art systems by providing a very large number of gray levels for faster-responding, high information, rms-responding, passive matrix LCDs.

More particularly, the method and apparatus of this invention provide a number of gray levels for an LCD by modulating the amplitude or pulse height of the display column drive signals.

As will be hereinafter described, the "pulse-height" or amplitude modulation addressing systems of this invention may be accomplished either in a "split interval" mode or in a "full interval" mode. Each such mode may be employed in either "standard" addressing methods or the "Swift" addressing method described in a copending application for U.S. Patent, Ser. No. 678,736, filed Apr. 1, 1991, which is assigned to the assignee of the present invention.

All these methods and the apparatus implementations thereof have in common the provision of means for generating and applying column signals whose amplitudes at any given time are directly related to the "gray" level or shade of color desired to be displayed by the pixels of the LCD panel and which are applied to the electrodes by multilevel drivers.

The advantage of pulse-height modulation in any of the forms described is that no matter how many gray levels are generated, there is no significant increase in high frequency components in the column signals.

BRIEF DESCRIPTION OF THE DRAWINGS

FIGS. 3A and 3B are schematic representations of the idealized voltages across a pixel comparing the prior art pulse-width modulation method (3A) with the pulse-height modulation method of this invention in the split interval, standard addressing mode (3B), showing the different voltage levels resulting from the application of signals to the row and column electrodes of FIG. 1.

FIGS. 5A and 5B are schematic representations of portions of idealized column signals respectively comparing those of the prior art pulse-width modulation method (5A) with the method of this invention in the split interval, standard addressing mode (5B) as applied to the column electrodes of FIG. 1.

FIG. 26 is a table showing a schedule of row sub-group selection intervals and non-select intervals.

DESCRIPTION OF THE PREFERRED EMBODIMENTS

LCD Panel Characteristics

Figure 1:
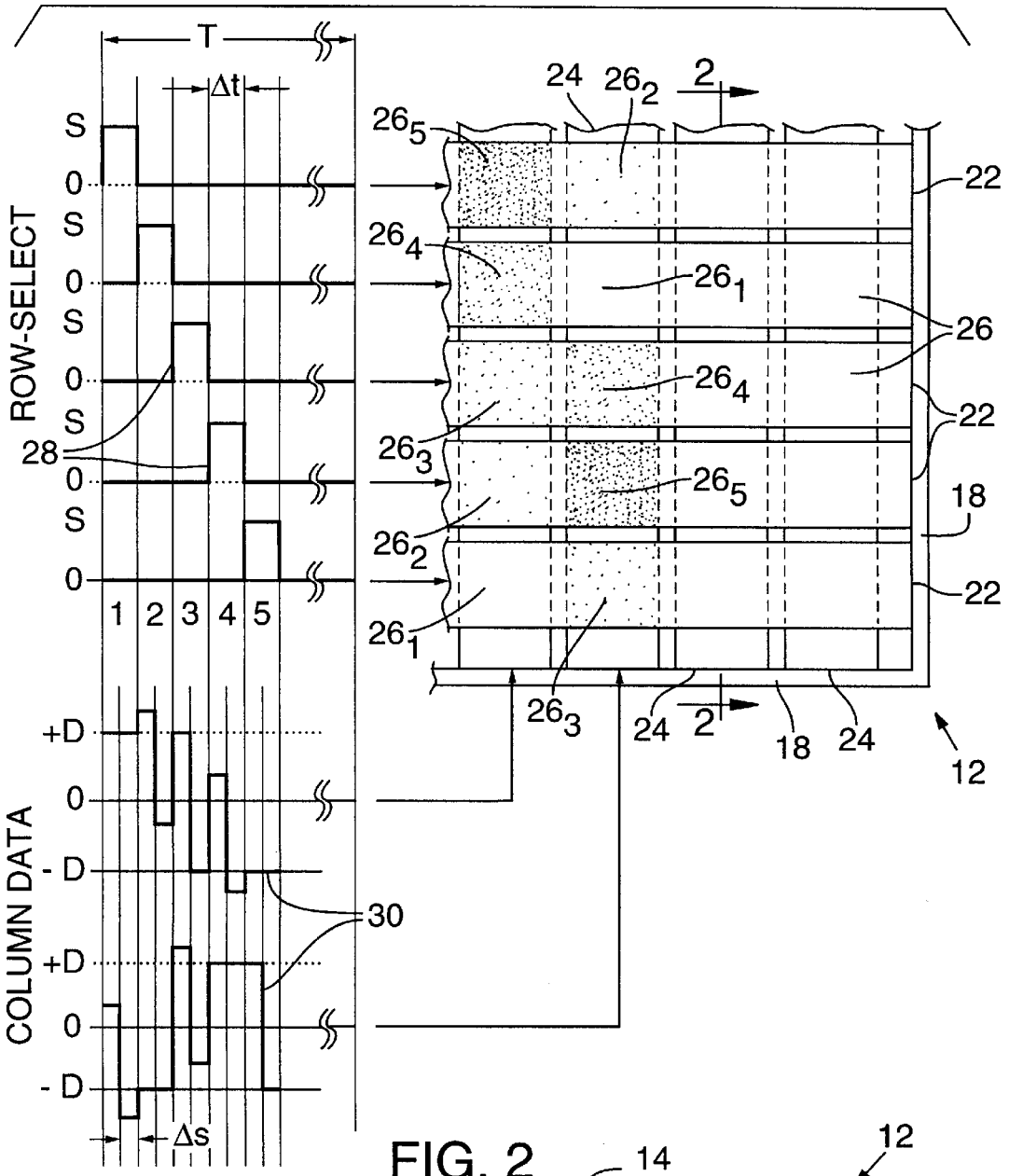
FIG. 1 is a semi-diagrammatic plan view of a portion of an LCD panel with a schematic representation of idealized signals applied to some of the row and column electrodes according to the method of this invention.

The method of this invention is applied to a typical flat panel display 12 (FIG. 1) of the type utilized in overhead projector panels, laptop computer screens and the like. High information content panels of this type operate through direct multiplexed, root-mean-square —responding (rms-responding) electro-optical effects, such as the twisted nematic (TN), supertwisted nematic (STN) or superhomeotropic (SH) liquid crystal display (LCD) effects.

Such panels typically comprise a pair of opposed, parallel, spaced glass plates or substrates 14 and 16 (FIG. 2) between which is a cell gap 20 where an electro-optical material 21 such as a liquid crystal is disposed. A seal 18 around the edges of substrates 14 and 16 serves to confine the liquid crystal material within the cell gap 20.

Liquid crystal display panels are characterized by an inherent time constant, i.e., the time required for the liquid crystal director to return to its equilibrium state after it has been displaced by a dielectric torque induced by an electrical field applied to the liquid crystal. The time constant, $\tau$, is defined by $\tau=\eta d^2/K$, where $\eta$ is an average viscosity of the liquid crystal material, d is the cell gap spacing or pitch length and K is an average elastic constant of the liquid crystal material. For a conventional liquid crystal material in a 7–10 $\mu$m cell gap, the time constant $\tau$ is on the order of 200–400 ms (milliseconds). Also in typical multiplexed LCDs, the information is refreshed at a rate of 60 Hz corresponding to a frame period of 1/60 seconds or 16.7 ms.

Relatively recently, LCD panel time constants have been reduced to below 50 ms by making the gap, d, between the substrates thinner and by using newly synthesized liquid crystal materials which have lower viscosities and higher elastic constants. These faster-responding panels, generally designated as any panel with a response time below 150 ms, make possible high information content displays at video rates.

Figure 2:
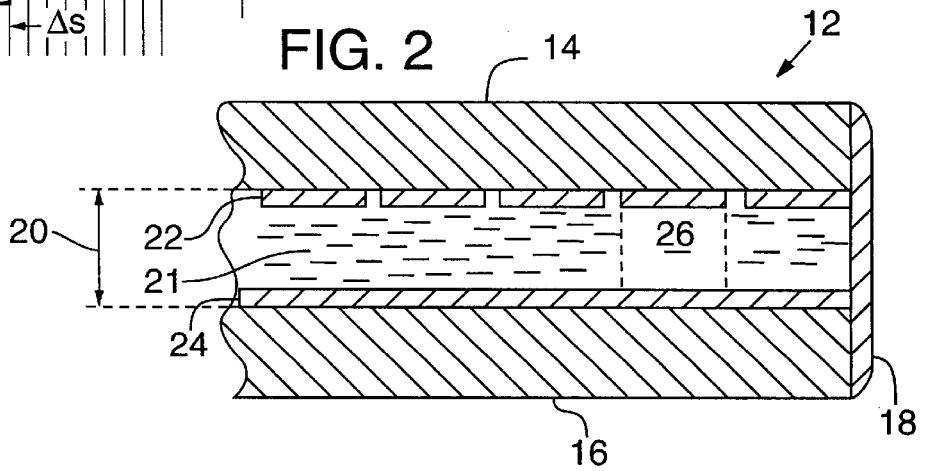
FIG. 2 is a cross-sectional view as seen from line 2—2 of FIG. 1.

In one common embodiment of an LCD panel, a matrix comprised of transparent electrodes is applied to the inner surfaces of the substrates, typically arranged in a plurality of horizontal or row or first electrodes 22 on the inner surface of substrate 14 and vertical or column or second electrodes 24 on the opposed inner surface of substrate 16 (FIGS. 1 and 2). Each area where the row and column electrodes overlap or cross create a matrix of picture elements or pixels 26 by which information is displayed on the panel 12. The arrangement of overlapping electrodes may take many forms, such as concentric rings and radial lines, although a matrix of row and column electrodes as disclosed is the most common pattern. High information content displays require large numbers of pixels to portray text and/or graphic images. Matrix LCDs having 480 rows and 640 columns forming 307,200 pixels are not uncommon and have provided high information content panels of approximately 10½-inch (27 cm) diagonal size.

Information is displayed on panel 12 by the relative degree of transmittance of light through the pixels, either from a light source on a side of panel 12 opposite from a viewer or by virtue of reflected light. The optical state of a pixel, i.e., whether it appears dark, bright, or an intermediate shade is determined by the orientation of the liquid crystal directors in the pixel area 26 (FIG. 2). The direction of orientation of the liquid crystal material 20 in the pixel area 26 and, hence, the transmittance of the pixel is changed by the application of an electrical field across the pixel. In direct multiplexed addressing techniques commonly used with matrix LCDs, the pixel "sees" an electrical field proportional to the difference in the signals, or voltages, applied to the electrodes 22 and 24 on opposite sides of the pixel. Those signals of appropriate frequency, phase and amplitude are determined by the information to be displayed from a video signal or other source.

"Standard" Addressing

In standard addressing of an LCD panel of N-number of rows and M-number of columns without gray levels, row select pulses of amplitude +S and width $\Delta t$ are sequentially applied to the row electrodes, which are otherwise held at no signal or zero voltage during the remainder of the frame period (FIG. 1). As used herein, to "select" a row means that a non-zero voltage is applied to the row. Width At is the "characteristic time interval" for standard addressing and is equal to the frame period, T, divided by the number of row electrodes, N, thus T/N.

During the same frame period, the column electrodes are each driven with a signal which is determined by the information to be displayed. For an "on" or "select" pixel, i.e., one which is to appear bright or have high transmittance, the column voltage is −D during the time interval that the row containing the pixel is addressed with a select pulse. For an "off" or "non-select" pixel, i.e., one which is to be in a dark or low or non-transmittance state, the column voltage is +D. Since the voltage applied to the pixel is the difference between the row and column voltages, a select pixel will "see" a pulse height or amplitude of S+D and a non-select pixel will "see" a pulse height of S−D during one characteristic time interval each frame period. During the remaining characteristic time intervals of the frame period, the pixels "see" voltage levels switching between +D and −D.

For maximum selection ratio, which is the ratio of the select or "on" rms voltage applied across the pixel divided by the non-select or "off" rms voltage applied to the pixel, the signal amplitude, S, of the row select signal is optimally related to the amplitude D of the column signal by:

$$S = \sqrt{N}\ D,$$

and D is related to the non-select rms pixel voltage $V_{ns}$ by:

$$D = V_{ns}\sqrt{\frac{\sqrt{N}}{2(\sqrt{N}-1)}},$$

where N is the number of multiplexed rows in the display.

The addressing technique referred to herein as "standard" addressing is described in detail by P. Alt and P. Pleshko, "Scanning Limitations of Liquid Crystal Displays" in *IEEE Transactions of Electron Devices* Vol. ED-21, No. 2, February 1974, pages 146–155. Subsequent improvements that have been made to eliminate D.C. voltages across the display and to decrease the power supply voltages and maximum voltage limits of the drive circuitry do not alter the basic principle of operation or its applicability to the gray level methods of this invention.

Figure 4:
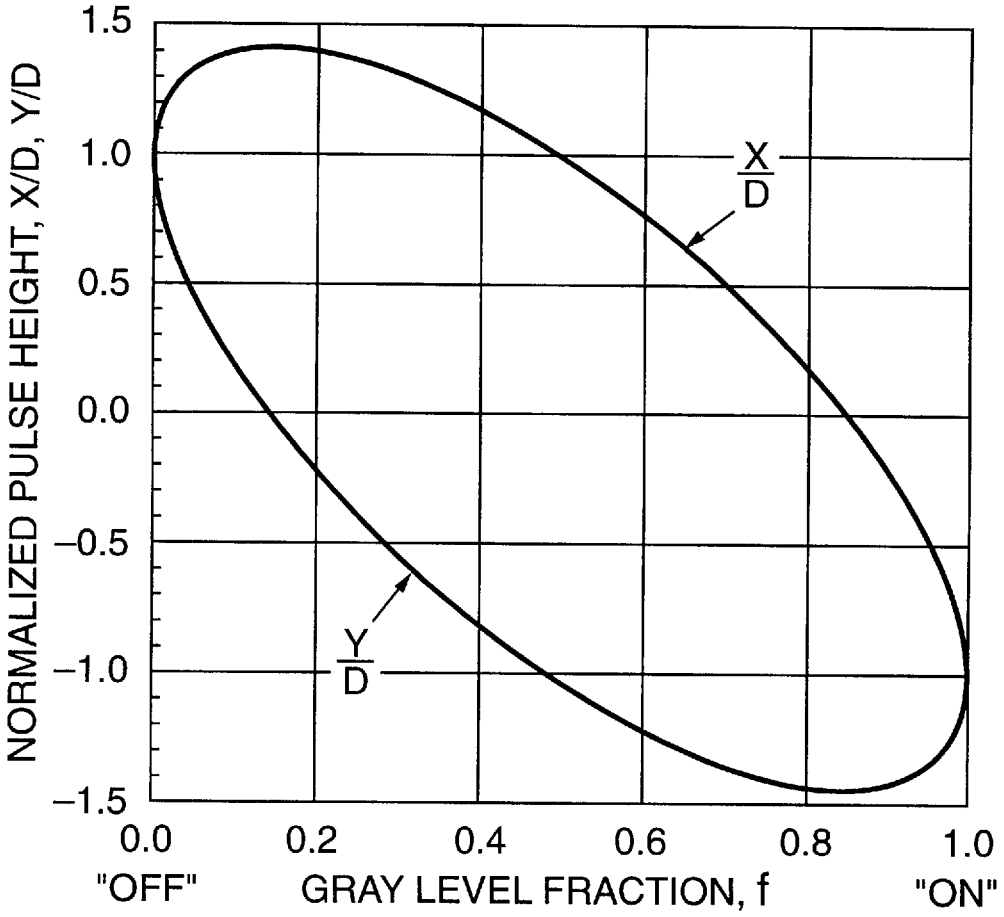
FIG. 4 is a graph of the normalized column voltages, plotted as a function of the gray level fraction computed according to the pulse-height modulation method of this invention in the split interval, standard addressing mode.

In the prior art pulse-width gray scale addressing system (FIG. 3A), a column signal of amplitude −D, corresponding to an "on" pixel, is applied for only a fraction, f, of the row select time interval, Δt, and a column signal of an amplitude +D, corresponding to an "off" pixel, is applied for the remaining fraction, 1-f. During the row select time interval, Δt, the amplitude of the signal "seen" by the pixel is S+D for the fraction, f, and S−D for the remaining portion, 1-f, of the time interval (FIG. 3A). Since the pixel sees a signal amplitude of either +D or −D over the remaining time intervals of the frame, the rms voltage across the pixel averaged over one frame period is intermediate between the rms voltage when the pixel is "on" and the rms voltage when the pixel is "off." The result is a pixel response in an intermediate optical state of transmittance or gray level. The fraction, f, also describes the relative position of the intermediate pixel voltage between the rms "off" pixel voltage and the rms "on" pixel voltage; that is, f is the gray level fraction varying between zero and 1 (FIG. 4).

It will be noted in FIG. 3A that the pulses become narrower and the high frequency content of the column drive signals increases with the number of gray levels. Because the higher frequencies are removed by the inherent low-pass RC filter action of the LCD panel, it is very difficult to realize more than about four to seven real gray levels on a display with the pulse-width modulation method.

"Swift" Addressing

The aforementioned U.S. patent application describes a Swift addressing system for LCD panels, which does not require the single, high amplitude row select pulse that causes frame response in standard addressing. The row or first signals of Swift addressing are characterized by:

1. A common frame period, T, and signals that are preferably orthonormal;
2. More than one row select pulse per frame period, the pulses preferably uniformly distributed over the frame period; and
3. Signals phased in such a way that a plurality of rows are "selected" (i.e., receive non-zero voltage) at any one time.

The most general kind of functions satisfying the above Swift criteria are continuous functions where the voltage levels are a continuous function of time. An example of such functions would be the orthonormal sine and cosine functions of various frequencies. For these types of functions there is no characteristic time interval and the sampling must be done on a continuous basis. These types of functions are well suited for analog implementation of Swift addressing.

Another class of functions that is particularly amenable for digital implementation of Swift addressing are the orthonormal bilevel functions which alternate over discrete time intervals, Δt, between two constant, non-zero voltage levels, preferably of the same magnitude but opposite sign. These functions can be represented by Hadamard matrices, which are square orthogonal matrices with the elements −1 and +1. The characteristic time interval, Δt, of such a function is the frame period T divided by the order of the Hadamard matrix. The order of any Hadamard matrix is divisible by 4, and thus can be represented by 4t, where t is a positive integer. Thus the characteristic time interval Δt is given Δt=T/(4t).

Walsh functions are a subset of Hadamard matrices having an order that is a power of 2, i.e., there are $2^S$ time intervals where s is an integer, such that $2^{S-1}<N\leqq 2^S$. The characteristic time interval in this case is $\Delta t=T/2^S$. Walsh functions are particularly useful for Swift addressing because fast Walsh transforms (FWT) are known which can considerably simplify the number of computations required to generate the column or second signals.

Other subsets of the Hadamard matrices that are particularly useful for Swift addressing are those subsets constructed from maximal length pseudo-random binary sequences. Except for one row and column, these are circulant matrices in which a new row function can be generated from a previous one simply by phase shifting it by one time interval. Like Walsh functions, this special type of Hadamard matrix has an order that is a power of 2, and thus the characteristic time interval is also given by $\Delta t=T/2^S$. Almost circulant Hadamard matrices can also be generated from Legendre sequences that have matrix orders that are given by (p+1)=4t, where p is a prime number. In this case the characteristic time interval would be given by Δt=T/(p+1). Almost circulant Hadamard matrices can also be generated from twin-prime sequences which have matrix orders of p(p+2)+1, where p and p+2 are both prime numbers. Here the characteristic time interval would be given by Δt=T/[p(p+2)+1].

Another class of Swift functions includes the multilevel orthonormal functions where the row voltage can attain three or more different voltage levels during discrete time intervals. Examples of these functions are the Haar functions and the slant functions which are both well known in digital signal processing for image transmission. Other multilevel functions can be derived by appropriately combining other orthonormal function sets. An example of this would be the mixed Walsh-Haar series. Multilevel pseudo-random sequences are also known.

Three-level Swift functions can be generated from the two-level Hadamard functions by expanding the size of the matrix and adding time intervals where the voltage level is zero instead of ±1 in such a way that the matrix remains orthogonal and the row is selected at uniform times over the frame period. This method is referred to as the sparse matrix expansion. This expansion can simplify the hardware implementation of Swift addresses because the product of information element and row voltage need not be taken over those intervals where the row voltage is zero.

For example, a 4×4 Walsh matrix could be transformed into an 8×8 Swift matrix by inserting a column of zeros after each Walsh column for the upper half and repeating this configuration for the lower half by cyclically shifting it by one column.

Larger matrices can be similarly generated by adding more columns of zeros between the Hadamard columns and appending an equal number of cyclically shifted versions to the bottom of the matrix. For example, adding two columns of zeros after each Walsh column of the 4×4 matrix and appending two shifted matrices onto the bottom results in a 12×12 Swift matrix.

It should be apparent that this operation preserves the orthonormality condition as well as uniformly distributes the selection intervals throughout the frame period, as per Swift conditions 1, 2 and 3, above. The characteristic time interval for these types of Swift function is the frame period divided by the order of the matrix (e.g., the number of matrix rows). Thus, depending on the matrix, as few as 2 or as many as N rows can be selected simultaneously. Time intervals, known as non-select intervals, in which none of the real rows are selected can be added. Such intervals do not have to be of the same duration as the characteristic time intervals.

Even more Swift row functions can be generated from the above mentioned ones by interchanging matrix rows, negating matrix rows (i.e., multiplying them by −1), interchanging matrix columns, negating matrix columns, or any possible combination of all four of these operations.

For Swift row addressing signals derived from other sequences, the characteristic time interval Δt is defined as the frame period divided by the number of elements in the sequence. The Swift column voltage at any time interval, Δt, is proportional to the sum of the products of the row voltages at that time interval and the desired information states (+1 for "off" or −1 for "on") of the corresponding pixels at the intersection of that column and those rows. The Swift column voltages thus can assume many values, not just the two, +D and −D, which characterize standard addressing.

Although prior art pulse-width modulation can be applied to Swift addressing to achieve gray levels, it suffers from the same problem, namely that the narrower pulses are too severely attenuated by the low-pass RC filter action of the LCD panel to ever reach the pixel. The end result is that an insufficient number of gray levels are available on the display to portray images to the desired fidelity.

Pulse-Height Modulation

In order to provide a substantially greater number of displayable gray levels without the concomitant increase in high frequency content of the column drive signals, the present invention provides methods of and means for applying to display columns variable voltage levels that are constant over time intervals substantially longer than the shortest time intervals that would have been utilized in generating the same number of gray levels by pulse-width modulation techniques. The methods and means of this invention are used to determine the values of the column voltage levels and their timing in order to ensure that each pixel of the display will adopt its predetermined gray shade without interacting with the gray levels of other pixels of the display.

The gray level methods and apparatus of this invention encompass two different modes to determine the values of column voltage levels and their timings in order to render the desired gray levels for each pixel on the display. In the split interval mode, two column voltage levels are computed for each characteristic time interval Δt. In the full interval mode, one column voltage level is computed for each characteristic time interval and at least one row is designated as a "virtual" or phantom row across whose virtual pixels voltages are determined by the information states or elements of all the other pixels in its column.

Split Interval Mode—Standard Addressing In the split interval mode (FIGS. 1, 3B, 5B) the characteristic time interval, Δt, is divided into two subintervals, Δs and a different column signal or voltage is applied over each subinterval. Preferably the two subintervals are of equal length to maintain the lowest possible frequency content of the column signal.

For the split interval mode, the amplitudes or voltage levels of the column signals, X and Y, applied during the two subintervals are chosen to provide the same rms voltage across the pixels during each time interval, Δt, that would have been applied if pulse-width modulation had been used. The resulting rms voltage across the pixels averaged over the entire frame period, T, will also be the same as if pulse-width modulation had been used and, hence, the gray levels will be the same.

The X and Y column voltages according to the method of this invention will satisfy the two conditions that the rms pixel voltages during both the selected and non-selected intervals match the rms pixel voltages during the corresponding intervals according to the pulse-width modulated method if they are determined by the equations:

$$X = D(1 - 2f + 2\sqrt{f(1-f)}),$$

$$Y = D(1 - 2f - 2\sqrt{f(1-f)}).$$

FIGS. 5A and 5B compare a portion of a pulse-width modulated column signal with the pulse-height modulated column signal of this invention. The values of the X and Y column voltages are obtained from the graph of FIG. 4 which plots the normalized column voltages, X/D and Y/D, as a function of the gray level fraction f. Every gray level fraction, f, is associated with two voltage levels, X and Y, except for the special cases where f=0 ("off") and f=1 ("on") in which X=Y (FIG. 4). Voltage X is arbitrarily applied over the first time subinterval, $\Delta s_1$, and voltage Y is applied over the second time subinterval, $\Delta s^2$.

In operation according to the method of this invention in the standard, split interval mode, the rows of display 12 (FIG. 1) defined by row electrodes 22 are selected sequentially by the application of the pulses of amplitude S of row signals 28. During the first time interval, Δt, that the uppermost row in FIG. 1 is being selected, column or second signals 30 of amplitudes X and Y (both equal to D, for example), related to the desired gray level of the uppermost left pixel of display 12 are respectively applied to the left most column during the first two subintervals, Δs. The result is that the voltage that the upper, left pixel denoted by reference numeral $26^5$ sees has a pulse height of S−D during the first time interval, and, therefore is "off" or dark.

Coincidentally, as a row select signal is applied to each successive row in the display during successive time intervals, the appropriate column signals X and Y related to the desired gray levels of the respective pixels will be applied during successive subintervals, Δs, to the respective columns. In the example of FIG. 1, the desired gray levels vary from 1 for "on" or bright to 5 for "off" or dark, with 2, 3 and 4 representing intermediate gray levels. The corresponding values of "f" (FIG. 4) are respectively 1, 0.75, 0.5, 0.25 and 0. The shading and the subscripts for pixels 26 in the two left columns of FIG. 1 are representative of the desired gray levels resulting from the generation and application of row and column signals of proper magnitude and timing according to the above described method.

FIG. 3B shows a portion of the idealized pixel voltage waveform, transformed according to the gray level method of this invention from a corresponding portion of the pixel voltage waveform of the pulse-width modulated gray level method of the prior art, as shown in FIG. 3A.

In the example given above, the number of time subintervals in the frame period and hence the frequency content of the column signals is twice that of the standard LCD drive without gray levels. Even though most of these frequencies are low enough to be passed by the RC filter action of the LCD, under some circumstances it may be advantageous to halve such frequency by doubling the width of the time subintervals and using two frame periods to supply the required voltage levels to the display. For example, the X and Y levels could be supplied alternately to the columns, as indicated above or alternatively, all of the X voltage levels and all of the Y voltage levels could be alternatively applied during time intervals of successive frame periods. In such cases the frequency content of the column signals would be the same as in standard LCD drive methods without gray levels.

Split Interval Mode—Swift Addressing

As mentioned above, one method to achieve gray levels with Swift addressing is to employ a pulse-width modulation technique. Using this technique the characteristic time interval, Δt, is broken up into unequal subintervals, Δs, whose lengths successively increase by powers of two and where the voltage level in each subinterval is determined by the information states of the respective bits in the gray level "words" for all pixels in the display column.

Figure 6A:
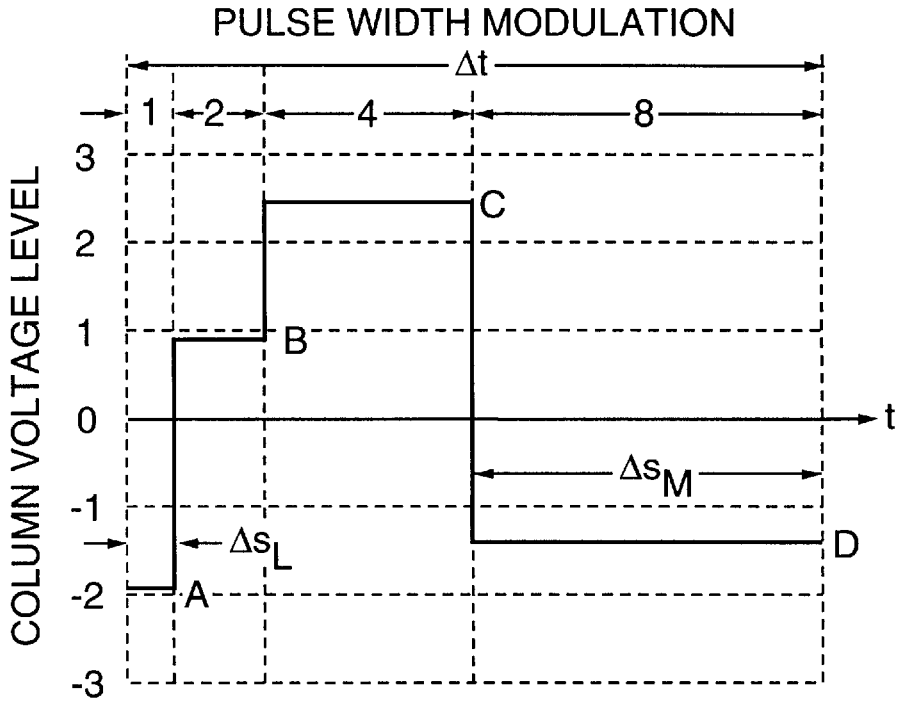
FIGS. 6A and 6B are schematic representations of portions of idealized column signals respectively comparing those of the pulse-width modulation method (6A) with the method of this invention in the split interval, "Swift" addressing mode (6B).

For example, FIG. 6A illustrates the column voltage levels in one characteristic time interval for a 4-bit gray scale, corresponding to 16 gray levels. (There are of course many such time intervals in the frame period, and each one will generally have a different set of column voltage levels.) In the time interval illustrated in FIG. 6A, the four voltage levels are symbolically represented by A, B, C, and D, where A corresponds to the least significant bit (LSB) of the gray scale and D corresponds to the most significant bit (MSB). The narrowest time subinterval corresponding to the LSB, $\Delta s^L$, has many high frequency components which reduce its effectiveness in determining a gray level because of the inherent RC filtering action of the LCD panel.

Figure 6B:
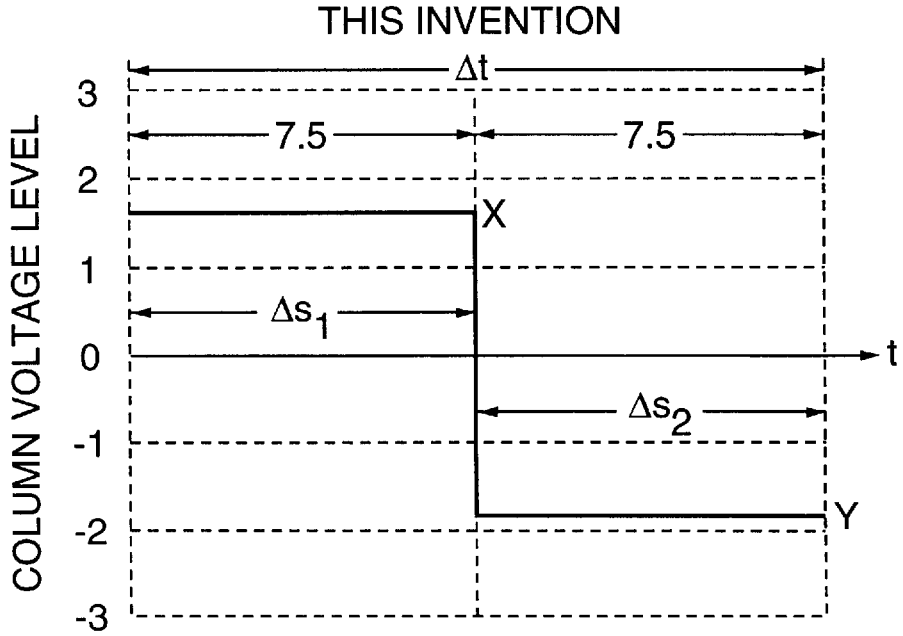

The gray level method of this invention avoids such high frequency components by employing a column signal as illustrated in FIG. 6B, which signal has only two voltage levels, X and Y, distributed over much longer time subintervals, Δs.

Similar to the procedure used for standard addressing, the values of X and Y are based on the column signal that would have been produced had the pulse-width modulation system been used.

Figure 8:
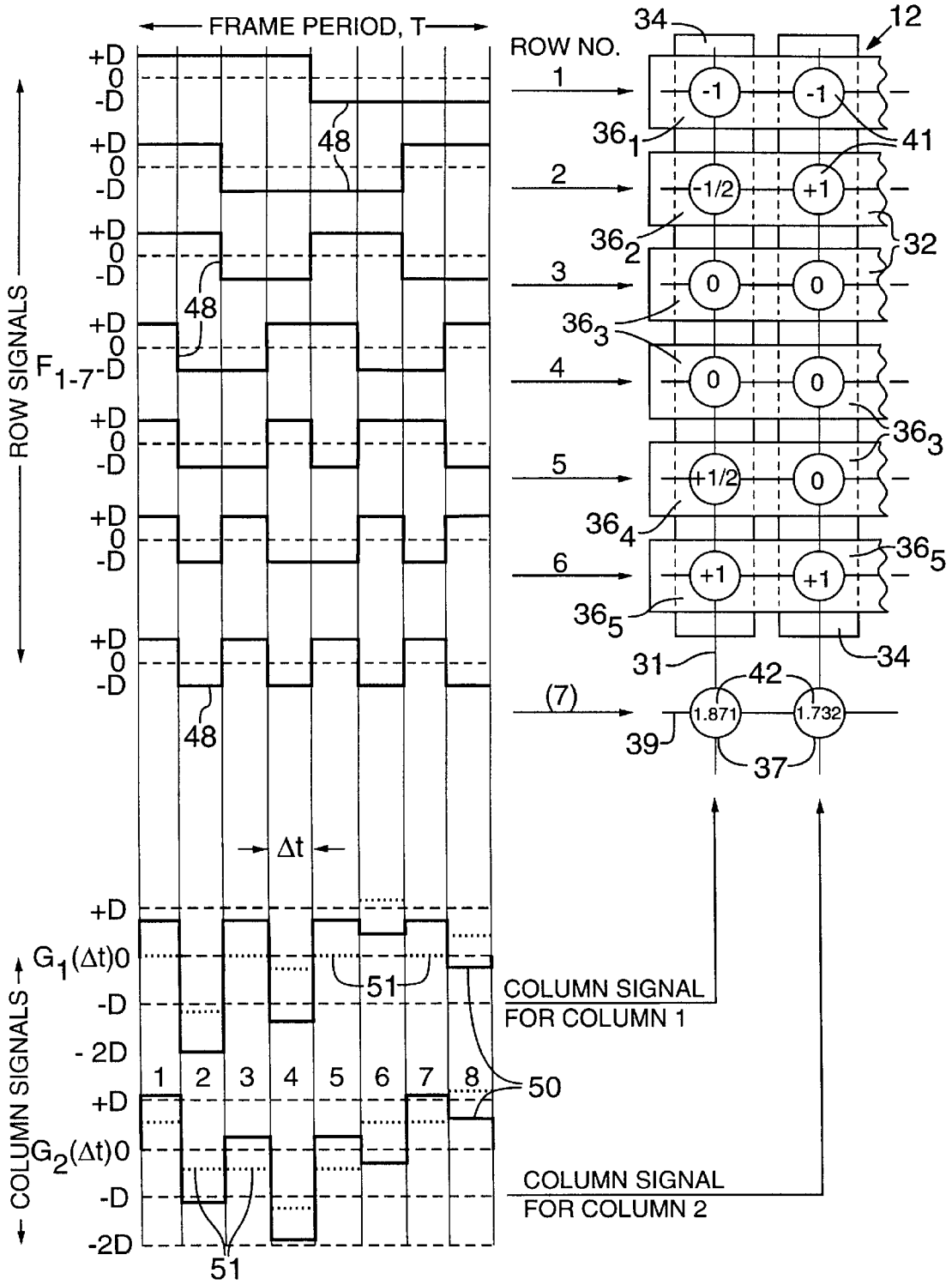
FIG. 8 is a view similar to FIG. 7 but with a schematic representation of idealized signals generated and applied according to the method of this invention in the full interval, "Swift" addressing mode.

In one implementation of Swift addressing, the display rows are driven with bilevel Swift signals during characteristic time intervals, Δt, where the row voltage levels are either +D or −D but are never zero (See FIG. 8 for example). The resulting pixel voltage is the difference between the column and row voltages, so in determining the rms pixel voltage over the characteristic time interval two cases must be considered: one when the row level is −D and the other when the row level is +D.

In order that the rms pixel voltage of the gray level method of this invention illustrated in FIG. 6B, be the same over the characteristic time interval, Δt, as the pulse-width modulated method of FIG. 6A, the column voltages, X and Y of the former are calculated by:

$$X = \frac{1}{2}\left[p + \sqrt{2q + p^2}\right],$$

and $$Y = \frac{1}{2}\left[p - \sqrt{2q - p^2}\right],$$

where p and q are related to A, B, C, and D by:

$$p = \frac{2}{15}\{A + 2B + 4C + 8D\},$$

$$q = \frac{2}{15}\{A^2 + 2B^2 + 4C^2 + 8D^2\}.$$

For the example illustrated in FIGS. 6A and 6B, A=−1.888, B=0.944, C=2.360 and D=−1.416. From the above equations, p=−0.252 and q=5.822 and, finally, X=1.576 and Y=−1.828. The above equations can easily be extended to include more gray levels. For example, for 8 bits of gray scale, i.e., 256 gray levels, E, F, G and H terms would be added to the above equations with respective multipliers of 16, 32, 64 and 128, and the fraction 2/15 changed to 2/255.

A more general statement of the above equations for determining p and q which would accommodate varying numbers of gray levels is:

$$p = \frac{2}{2^n - 1}\sum_{g=1}^{n} 2^{g-1}G_g,$$

and $$q = \frac{2}{2^n - 1}\sum_{g=1}^{n} 2^{g-1}G_g^2,$$

where n is the number of gray bits in the gray level word, g is the position of the gray bit in the gray level word, and $G_g$ is the column voltage level for the $g^{th}$ gray bit.

In the case of 16 gray levels illustrated in FIGS. 6A and 6B, the narrowest pulse width in the column signal of this invention (FIG. 6B) is 7.5 times wider than the narrowest pulse in the pulse-width modulation method of FIG. 6A, resulting in 7.5 times lower frequency components in the column signal and much less filtering by the LCD panel. This factor for the general case of n bits of gray scale is equal to $(2^n-1)/2$ and would be 127.5 for the example of 8 gray bits or 256 gray levels.

As in the standard addressing, split interval mode, row signals which are independent of the information to be displayed are applied to the row electrodes coincidentally with the application of column signals representative of such information to the column electrodes, resulting in the pixels displaying the desired information in the appropriate gray levels.

Full Interval Mode—Standard Addressing

One of the characteristics of the Swift addressing method described in applicants' pending application, U.S. Ser. No. 678,736, is a provision of an information matrix (generally designated 31 in FIGS. 7 and 8). Matrix 31 is made up of pixel information elements 41 which correspond one-to-one to the matrix of pixels 36 shown in FIGS. 7 and 8 at the intersections of rows 32 and columns 34. The pixel information element 41 corresponding to the pixel 36 at each of said intersections designates the desired "state" or gray level of the associated pixel.

In the full interval mode of the gray level addressing system of this invention, the values, I, of pixel information elements 41 may vary between −1 for "on" (or, for example, bright transmittance) to +1 for "off" (or, for example, dark transmittance). Any value between these lower and upper limits designates a gray level which it is desired that the associated pixel display.

In addition to the pixel information elements associated with the "real" rows 32 and columns 34 defining "real" pixels 36, the information matrix 31 of this invention for operating in the full interval mode requires at least one "virtual" or phantom row 39 (FIGS. 7 and 8) which crosses or overlaps extensions of columns 34 to provide virtual pixels 37.

With every virtual pixel 37 there is associated a virtual information element 42 whose value, V, is determined by the values, I, of pixel information elements 41 in that column. For the case of one virtual row, the value of the virtual information element, V, associated with each column, is determined from:

$$V = \pm\sqrt{N - \sum_{i=1}^{N} I_i^2} \quad ,$$

where N is the number of rows in the display, and $I_i$ is the value of the pixel information element of the i-th real row.

From the above equation it can be seen that the virtual information element is zero when there are no pixels with gray levels in the column (i.e., all pixels are "on" or "off").

The column signals depend upon the information to be displayed. In the full interval mode with standard addressing the column signal at any time is proportional to the value of the information element of the selected row, real or virtual (I or V). More precisely, the column signal, G, for each column at the time interval, Δt, when a real row is selected is given by:

G=DI, and during each time interval that a virtual row is selected, the amplitude of said column signal G is determined by:

G=DV.

When the gray level method of this invention operating in the full interval mode is applied to displays using standard row addressing signals (FIG. 7) the characteristic time interval, Δt, is the frame period, T, divided by the sum of the number of real display rows, N, and the number of virtual display rows, n, thus, Δt=T/(N+n).

Figure 7:
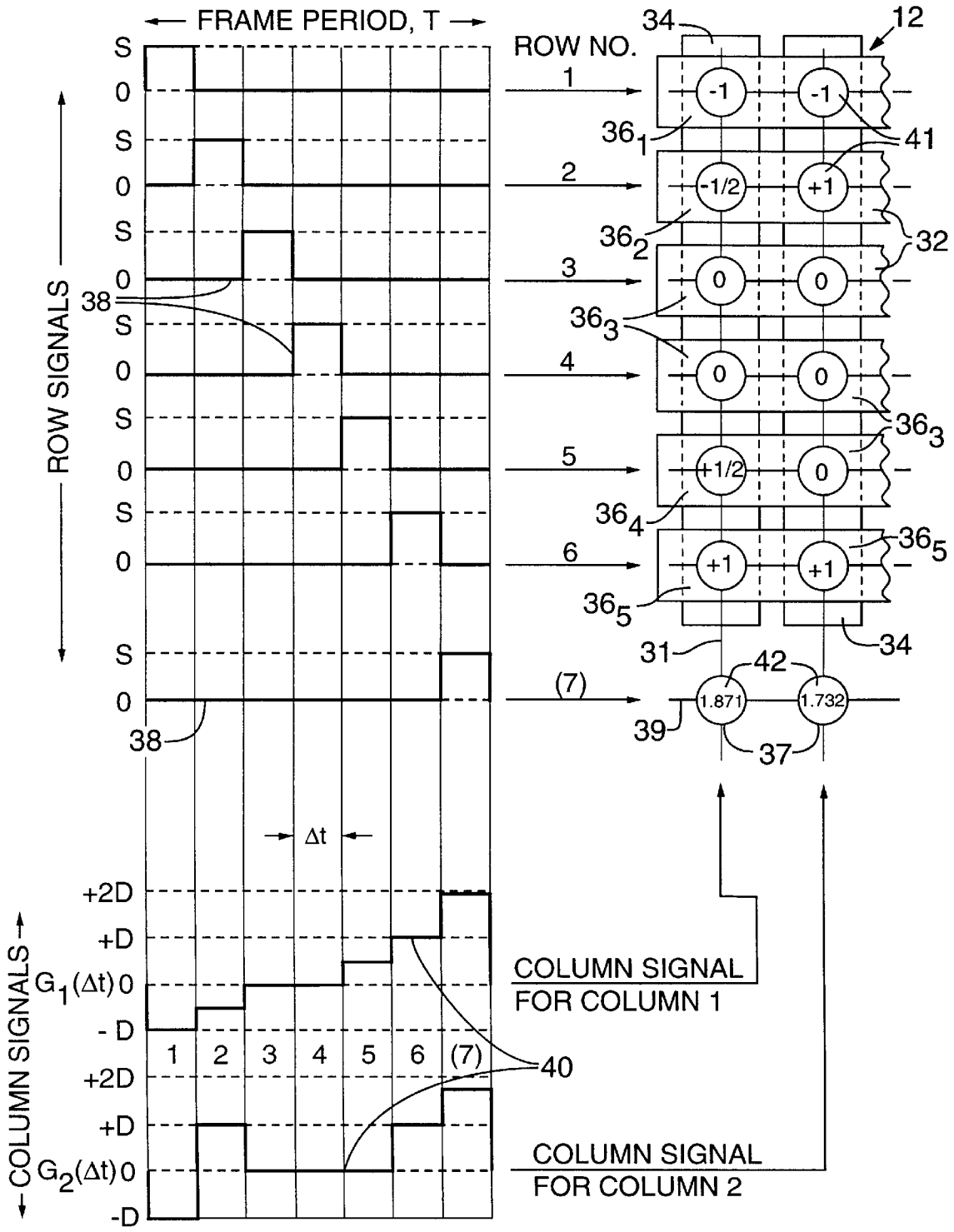
FIG. 7 is a semi-diagrammatic plan view similar to FIG. 1 of a portion of an LCD panel with a schematic representation of idealized row and column signals generated and applied according to the method of this invention in the full interval, standard addressing mode and with a portion of a matrix of information elements superimposed over the matrix of pixels.

In the FIG. 7 example the display has 6 real rows 32, numbered 1–6 and one virtual row indicated by (7). The row signals are sequential block functions that have zero level everywhere except during the row select interval where the level is S. The rms value of these functions is D.

The desired gray levels of the pixels 36 in FIG. 7 are represented by the pixel information elements 41. In column 1 those elements are −1 in row 1 representing "on" or white, −½ representing light gray in row 2, 0 representing medium gray in rows 3 and 4, +½ representing dark gray in row 5 and +1 representing an "off" or black pixel at row 6. The corresponding shades or levels of gray to be displayed at pixels 36 in column 1 are represented by the subscripts, 1–5. The information elements in column 2 correspondingly represent the white, black and medium gray shade for the pixels 36 in that column.

From those examples the virtual information elements 42 for each of the columns 1 and 2 may be calculated according to the previous equations as:

for column 1, $V=\sqrt{6-2.5}=\sqrt{3.5}=1.871$, and for column 2, $V=\sqrt{6-3}=\sqrt{3}=1.732$.

The column signal $G_1$, for the first column over the 7 time intervals of the frame period is therefore −D, −½D, 0, 0, +½D, +D, and 1.871D. For column 2 the column signal $G_2$, over the 7 time intervals is −D, +D, 0, 0, 0 +D and 1.732D, respectively.

It will be noted that the amplitudes of the column signals in FIG. 7, normalized by D, are identical in value, sign, and sequence to the information elements of the respective pixels in the columns. The final time interval in the column signal is the adjustment term derived from the respective virtual information element that appropriately adjusts the rms voltage appearing across all the pixels in the column.

Because the optical response of the pixels depends not only on the rms voltage across them, but also on the frequency components of the addressing signals, it may be necessary, depending upon the frequency components of the virtual row signals to adjust the value of V by a few percent. The exact adjustment is determined empirically and the same adjustment is typically applied to all the virtual pixels in a virtual row.

A simplified version of standard LCD addressing has been described for the sake of clarity. In the LCD display industry it is common practice to periodically offset and invert both row and column signals in order to reduce the voltage swing requirement for the row driver electronics and to prevent net D.C. voltages from appearing across the pixels, which voltages could potentially damage the liquid crystal material. These measures affect neither the rms voltages appearing across the pixels nor their optical states. One skilled in the art will realize that these measures can be applied to the row and column signals of the present invention to achieve the same results.

Full Interval Mode—Swift Addressing

The concept of information elements associated pixels having values that vary between −1 for "on" and +1 for "off" with intermediate values designating intermediate states, or gray levels, can also be applied for the case of the full interval method used with Swift addressing. The concepts of virtual rows, virtual pixels and virtual information elements apply as well.

Swift addressing uses different row addressing waveforms than the sequentially pulsed row addressing waveforms of standard addressing. Like standard addressing waveforms, Swift row addressing waveforms form an orthonormal set. The difference is that each row in Swift addressing is "selected," i.e., has a non-zero voltage applied to it, by pulses applied to it a plurality of times during a frame period, and, during time intervals in which a row is selected, more than one row is typically selected.

In the full interval mode with Swift addressing the amplitude of the column signal at any time, t, is proportional to the sum of the products of the real and virtual information elements of the pixels in that column and the amplitude or level of the row signal associated with that pixel at that time, t. The signal for each column at any time t, G(t), equals:

$$\frac{1}{\sqrt{N}}\sum_{i=1}^{N} I_i F_i + \frac{1}{\sqrt{N}}\sum_{k=N+1}^{N+n} V_k F_k$$

where N is the number of multiplexed real rows, $I_i$ is the pixel information element at a particular row, $F_i$ is the amplitude of the row signal applied to that row at said time, $V_k$ the information element at a particular virtual row, and $F_k$ is the amplitude of the virtual first signal, i.e., the row signal associated with that virtual first electrode or row at that time.

In this equation, the root-mean-square values of the row signals are equal to D. The first or "dot product" term is the sum, taken over the N real rows of the display, of the products of the gray level information state, I, of a pixel and the voltage applied to its row. The second or "adjustment" term is the sum, taken over the n virtual rows of the display, of the products of the virtual information elements, V, and their corresponding virtual row voltages. The second term is added to the first in order to adjust the column signal to obtain the proper rms voltage across the pixels. The second term ensures that column signals applied to different ones of the column electrodes have during a frame period substantially the same rms voltage to produce a uniform brightness of pixels having the same desired gray levels, but located in different columns. If the value of $V_k$ were determined in accordance with the equation, all columns would have the same rms voltage over a frame period. Because the value of $V_k$ may be adjusted by a few percent to compensate for the frequency dependence of the optical response of the display, the column rms voltages may differ slightly, but will be substantially equal.

FIG. 8 shows the same display and matrix 31 with the same information pattern as in the example of FIG. 7, except that Swift row addressing signals 48 are applied to the six real matrix rows 32. In this example, bilevel Swift row signals based on the second through seventh sequence-ordered Walsh functions are applied to the six real display rows, but other Swift row functions would be equally applicable. The virtual display row 39 (7) is associated with the eighth Walsh function. The amplitudes of the row signals are either +D or −D and are orthonormal to each other. In contrast to the previous example of FIG. 7, the row function for the virtual row 39 in FIG. 8 does not involve an additional characteristic time interval. This is because the Walsh functions are part of a complete or closed orthonormal set whereas the sequential block functions used in standard LCD addressing are part of an incomplete or open set.

For the full interval, Swift addressing system of FIG. 8, the virtual information elements 42 are computed as in the previous example, and have the same values since the desired display information pattern for pixels 36 is the same.

The amplitudes, G(Δt), of the column signals 50 for this operation are determined for each of the 8 time intervals, Δt, by calculating the first component related to the sum of the products of the amplitudes, ±D, of the row signals 48 and the pixel information elements 41 for each row 32 and adjusting that component by the adjustment term related to the product of the amplitude, ±D, of the row signal 48 associated with virtual row 39 and its virtual information elements 42, since only one virtual row is present.

The resulting column signals are shown in FIG. 8. The dotted line levels 51 indicate what the amplitudes of the column signals would be without the adjustment term. Such signals would not produce the rms voltage across the pixels 36 necessary to provide the desired optical state. The solid line levels 50 include the virtual row adjustment term and therefore give the proper rms voltages across the pixels. It is worth noting that in FIG. 7 the column signal adjustment term manifests itself as an additional time interval, whereas in FIG. 8 the adjustment is spread out over all the time intervals.

Of course a practical high information content display has many more than 6 multiplexed rows. The VGA resolution screens used in laptop and notebook computers, for example, typically have 240 multiplexed rows and SVGA screens have 300 rows in each half of a dual scan display. The above example could easily be extended to this case by setting N at 240 or 300 in the various equations.

Addressing such large displays, however, requires a great number of calculations in every addressing interval to determine the magnitude of all the column signal G(Δt). The calculations of column signal magnitudes can be simplified if one of the two terms in the above equation for G(Δt) is always zero. This can be accomplished by using for virtual row signals functions that are always zero when any real row signal function is non-zero. Thus, during addressing intervals when real rows electrodes are selected, no virtual row is selected and during time intervals when a virtual row is selected, none of the real rows are selected. Such a condition also obtains during the full interval Standard Addressing case described above.

Figure 18:
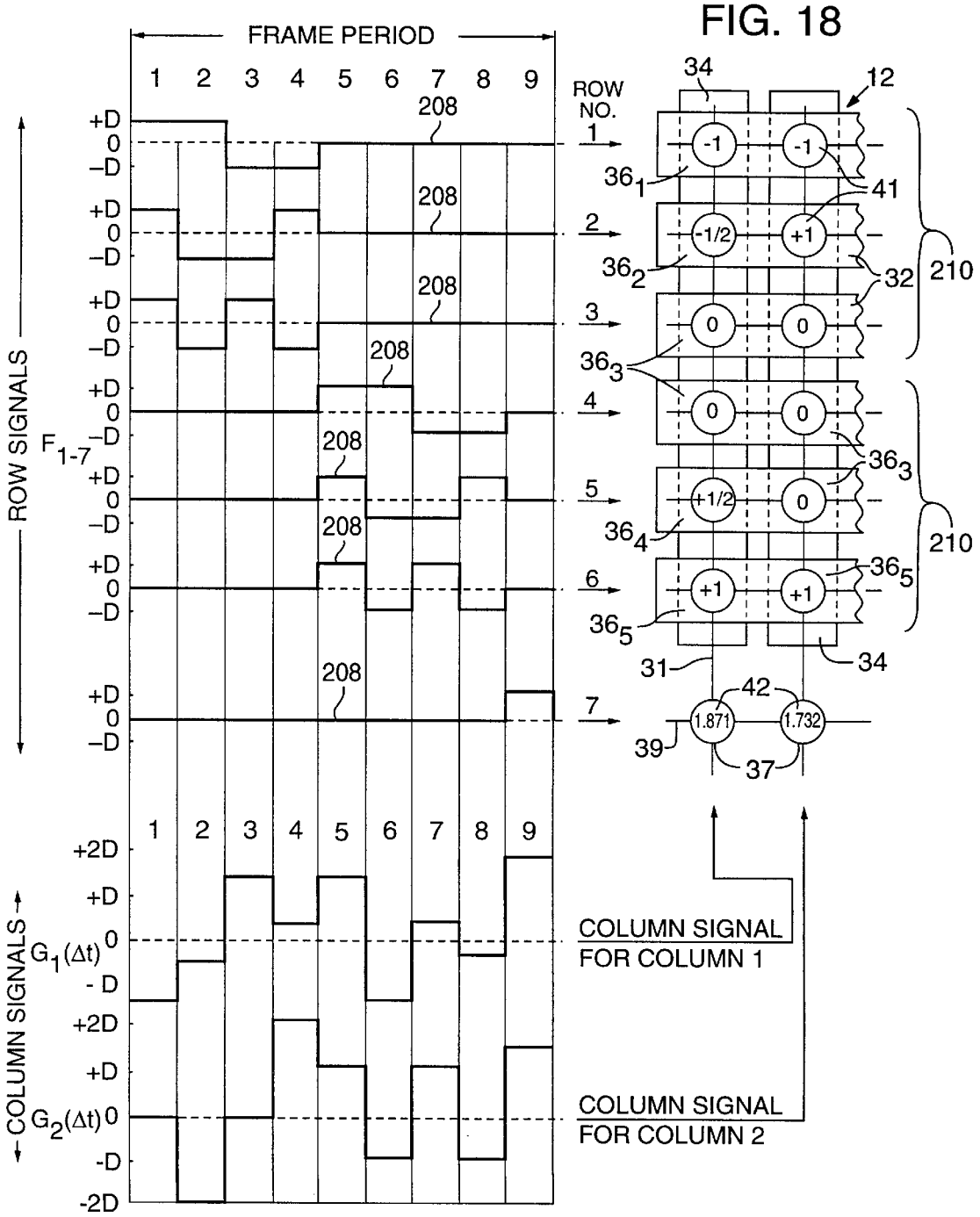
FIG. 18 is a view similar to FIG. 8 but showing virtual row signals that do not select virtual rows in addressing intervals in which real row electrodes are selected.

FIG. 18 is a block diagram similar to FIG. 8, but showing virtual row signals that do not select both real and virtual rows in the same addressing interval. FIG. 18 shows the use of three level row addressing signals 208. Each row signal comprises during part of the frame one of the Walsh functions of a second order Walsh matrix and is zero during part of the frame, when other real or virtual rows are being selected. The value, V, of each virtual pixel information element is determined as described above and the magnitude, G(Δt), of the column signal is determined as described previously in this section.

One of the two terms in the equation for G(Δt), however, will always be zero, thereby simplifying the calculation. By selecting fewer than all of the real rows at any particular time, the number of calculations required to determine the contribution to G(Δt) of the real rows is also greatly reduced. The row signal applied to row number 7, the virtual row, is not a member of the Walsh function set used for addressing the real rows, but is still orthonormal to the other row addressing signals.

FIG. 18 shows the first three rows being selected during a first part of the frame period and the second three rows being selected in a second part of the frame period. Each of the three rows forms a sub-group 210 that is addressed by group of second order Walsh functions. During the frame period when the Walsh function signals are not applied to rows in the sub-group, the rows are held at zero voltage. One skilled in the art will recognize that zero voltage is in relation to a reference voltage level, which is typically not zero relative to a ground potential. Column signals G(Δt) are determined as described above.

Figure 19:
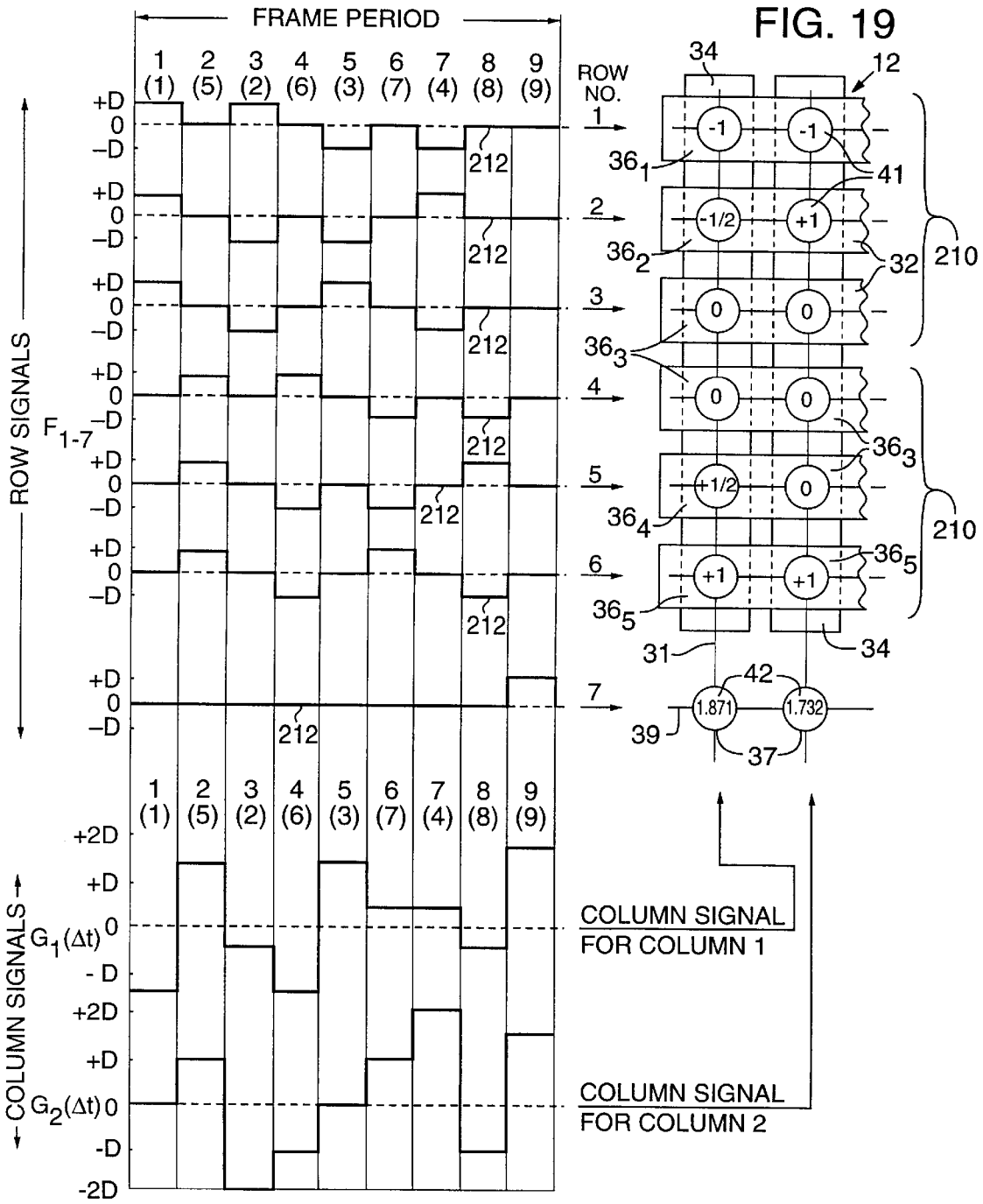
FIG. 19 is a view similar to FIG. 18 but showing the selection intervals for each real row electrode distributed throughout the frame period.

To reduce frame response, i.e., optical variations within a frame period when using a fast responding liquid crystal material, it is preferable to distribute the selections intervals for all the rows throughout the entire frame period as shown in FIG. 19. In FIG. 19, the Walsh functions selection pulses from the two sub-sets of row electrodes are alternated to form row signals 212. One could arrange the row selection pulses and corresponding column signals in any manner that distributes the selection pulses sufficiently to eliminate frame response.

Figure 20:
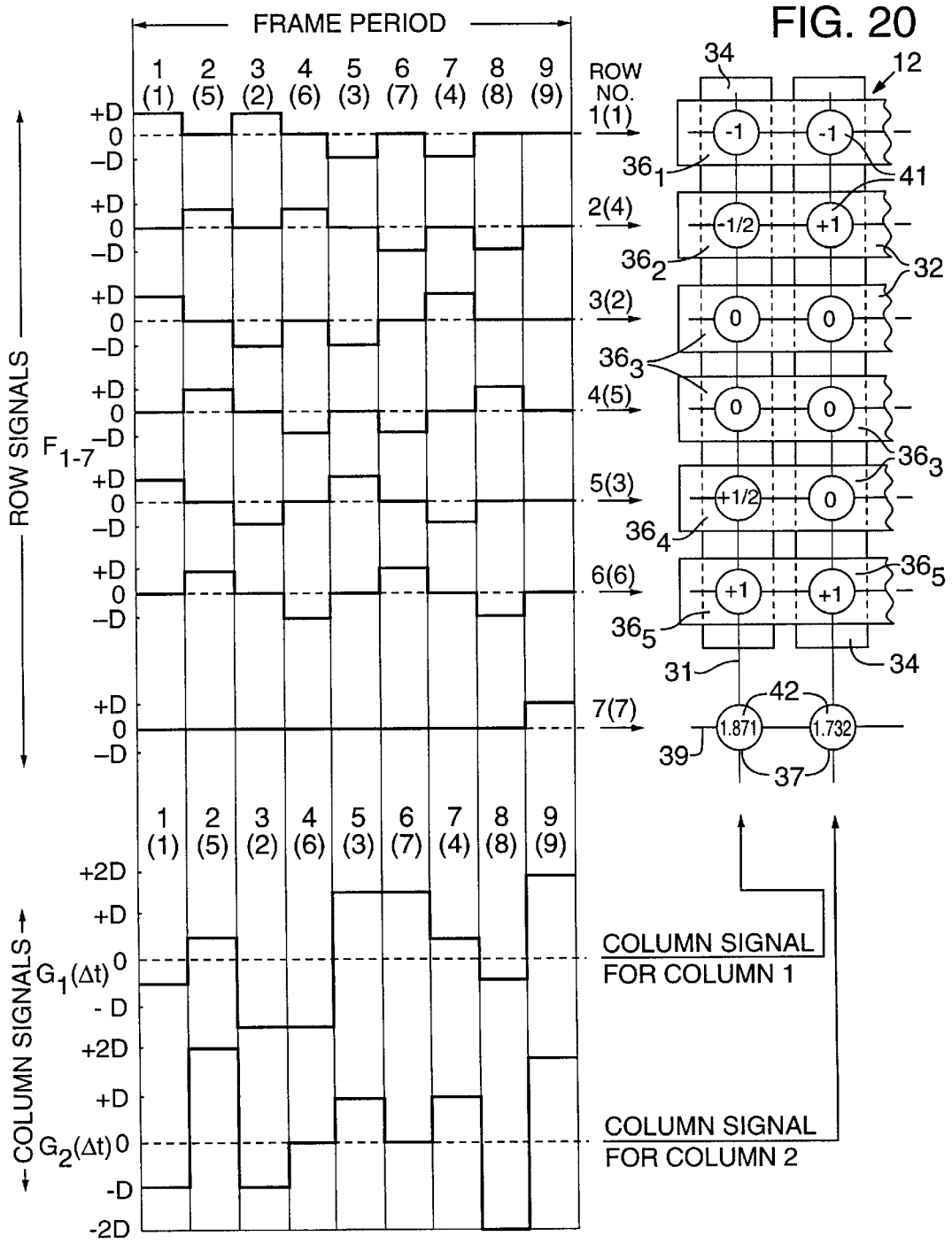
FIG. 20 is a view similar to FIG. 19 but showing row electrode subgroups composed of non-contiguous rows.

Brightness variation between sections of the displayed image may be reduced if the rows composing each subset are not contiguous. FIG. 20 shows Walsh functions rows signals from the two sub-groups being applied to every other row. One could also distribute the rows within each sub-group in any other manner, including a random distribution.

As described above, the purpose of the virtual pixel is to adjust the column rms voltage over a frame period so that all pixels having the same desired gray level appear equally bright, regardless of the column in which the pixel is located. In the embodiment of FIGS. 18 and 19, there are time intervals, i.e., non-select intervals, in which none of the first electrodes is selected, and during which a column signal is applied that adjusts the column rms voltage for the frame.

Because the virtual row signals are zero only when the real row are non-zero, the virtual row signals are orthonormal to the real row signals, although the virtual row signals are not necessarily part of the Walsh matrix. The duration of the virtual row select pulses does not need to be equal to the characteristic time interval to maintain orthonormality.

When the column voltage required to adjust the frame rms voltage is applied in a single characteristic time interval, as shown in FIGS. 18–20, a very large column signal can result, thereby producing a noticeable change in brightness within a frame period. Selecting the virtual row one time in each frame period produces an effect similar to that in standard addressing in which the real rows are selected one time in each frame period. The adjustment column signal, which can be considerably larger than the column signals required during time intervals in which rows are selected, would also require more expensive column drivers to produce.

Figure 21:
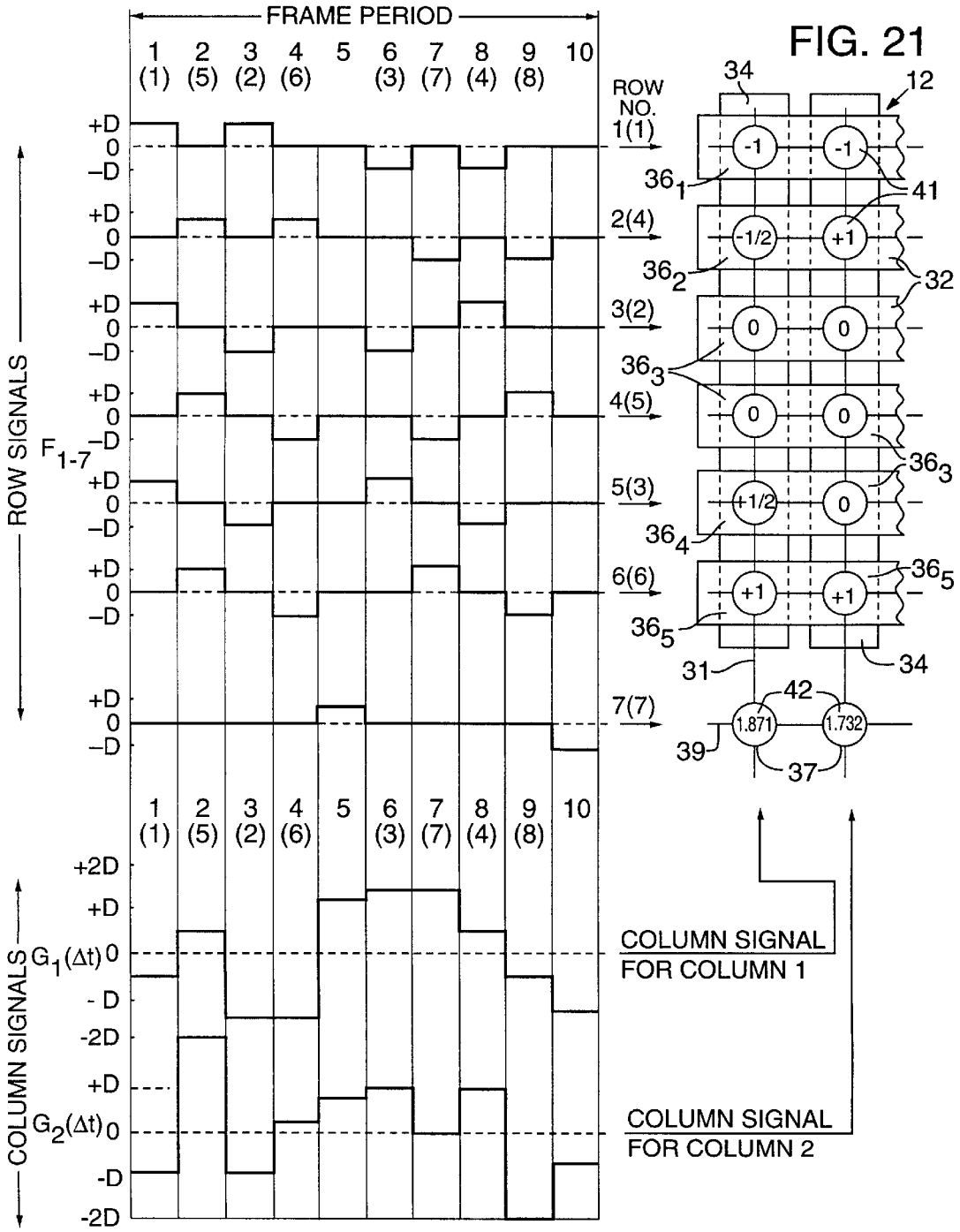
FIG. 21 is a view similar to FIG. 20 but showing an adjustment signal spread over two selection intervals.

The magnitude of the required column signal can be reduced by lengthening the time period during which a signal is applied to the column in such a manner that the contribution to the frame rms voltage remains constant. The period during which the virtual row is selected can be of arbitrary duration and does not need to have a duration equal to that of the characteristic time intervals used while addressing the real rows. FIG. 21 shows column adjustment signals applied during two time intervals, each being equal in duration to a characteristic time interval. By doubling the time in which the column adjustment signal is applied, the magnitude of each column adjustment signal can be significantly reduced, while still producing the same rms voltage over a frame period. Although FIG. 21 shows signals applied during two time periods, the column adjustment rms voltage required to adjust the column rms voltage was determined using a single virtual pixel. The polarity of the applied column signal is reversed in the two time periods to prevent a net DC voltage across the pixels in the column.

Figure 22:
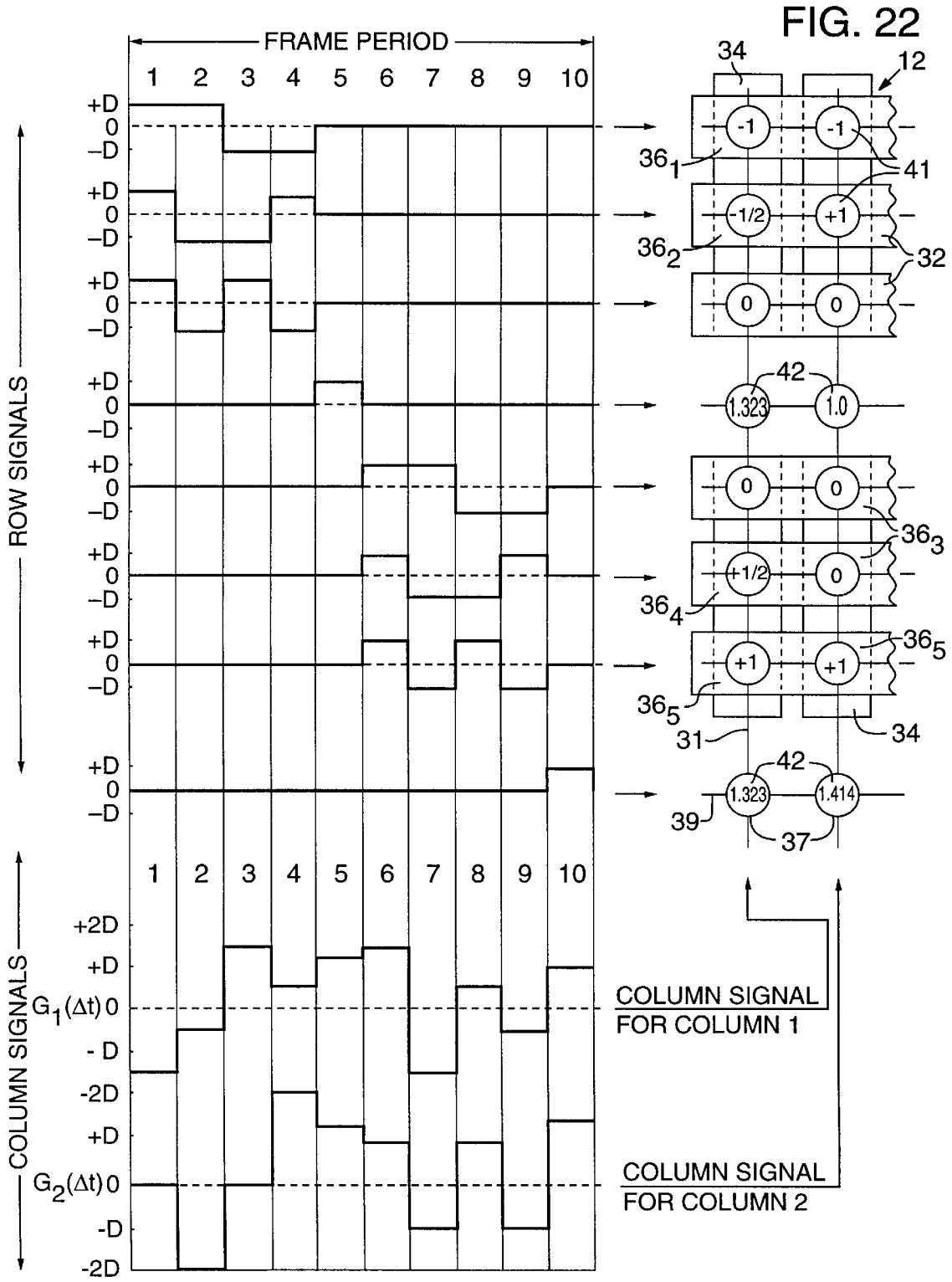
FIG. 22 is a view similar to FIG. 18 but showing the use of two virtual rows.

Another method for reducing the magnitude of the required column signals is by using multiple virtual rows, as shown in FIG. 22. By using multiple virtual rows, the adjustment to the frame rms voltage of the column electrodes is also spread over multiple selection intervals. The value of each virtual pixel is calculated by the equation defining "V" above, but by replacing N, the total number of rows, with the number of rows in a subset of rows being used to define the virtual pixel. It will be understood that the number of subsets of rows, and therefore the number of virtual pixels and non-select periods, can vary between one and N, with the number of rows in each subset used to determine the virtual pixel value varying accordingly.

When multiple virtual rows are used, the column signal, $G(\Delta t)$, determined for the time period in which each of the virtual rows is selected determines an adjustment rms voltage. The adjustment rms voltage associated with each virtual pixel in a column can be applied to the column during a single characteristic time interval, during a time interval of arbitrary length, or during multiple time intervals.

In any of the embodiments above, the magnitude of the column signal is limited by the capabilities of the column drivers. In a commercial embodiment, additional non-select intervals are added until the required column signal voltage required to apply the adjustment rms voltage is within the capability of the existing drivers, which capability is primarily determined by the maximum magnitude G of column signals when real rows are selected. It is not always necessary to use the maximum voltage levels available on commercially available driver to achieve the largest magnitude G required in a particular display, so the voltage available on a column driver for a column signal during a non-select interval may be greater than the maximum voltage applied during select intervals.

To determine a preferred number of non-select intervals, one determines a voltage corresponding to the maximum adjustment signal likely to be required for a column, and then determines the number of time intervals required, at the maximum output of the column drivers, to produce the same effect on the frame rms voltage as a single time interval at the maximum adjustment signal voltage.

For example, if the column drivers have a gain of A (that is, a column voltage during a select time interval is $A \times G(\Delta t)$) and the maximum adjustment column signal likely for the non-select interval is designated $G_V$, a non-select interval scale factor, B, that is dependent on the number of time interval over which $G_V$ is distributed, is determined by $$B = \sqrt{\frac{\text{number of time intervals per sub-group}}{\text{number of non-select time intervals per frame period}}}$$

number of non-select time intervals per frame period A number of non-select intervals is chosen such that the maximum magnitude, $B \times G_V$, of the column signals during the non-select intervals is less than or equal to the maximum magnitude of a column signal that can be produced by the column drivers.

Typically, a frame period has a fixed duration and the insertion of additional time intervals during a frame period results in the shortening of each of the time intervals. As the time intervals become very short, the reduced response of a liquid crystal display to high frequency components of the addressing signals becomes a problem.

The frequency dependence of the optical response of liquid crystal displays is described in U.S. patent application Ser. No. 08/077,859 for "Addressing Method and System Having Minimal Crosstalk Effects," filed Jun. 16, 1993, and assigned to the assignee of the present application. Even if the rms voltage over a frame period is the same for all pixels, their brightness can vary if the frequency components of the addressing signals are different. There is a relatively stable frequency band, roughly between 1,000 Hz and 20,000 Hz, in which the optical response is relatively constant with frequency changes. Addressing signals having significant frequency components below 1,000 Hz tend to produce brighter pixels and addressing signals above 20,000 Hz tend to produce darker pixels.

The frequency components of the virtual row signals can affect the brightness of pixels in a column. Also, the arrangement of the non-select intervals within a frame affect the frequency components of the column signals. The frequency dependent effects of gray level addressing can be compensated by applying a constant correction factor to the calculated value of V, the virtual pixel information element value. Typically, a multiplicative correction factor is empirically determined and the same correction factor is applied to all virtual pixels defined by the same virtual row. The correction factor typically has a value of about 0.99 and is in a preferred range from about 0.98 to 1.2.

When column signals are calculated as described above using V without a correction factor, the rms voltages of all columns are equal during a frame period. When the correction is applied to V, the rms voltages of the column electrodes are no longer exactly equal, but are still substantially equal. The small difference in rms voltages between columns compensates for the frequency dependence of the optical response, so that pixels in different columns having the same pixel information value appear equally bright.

Figure 23:
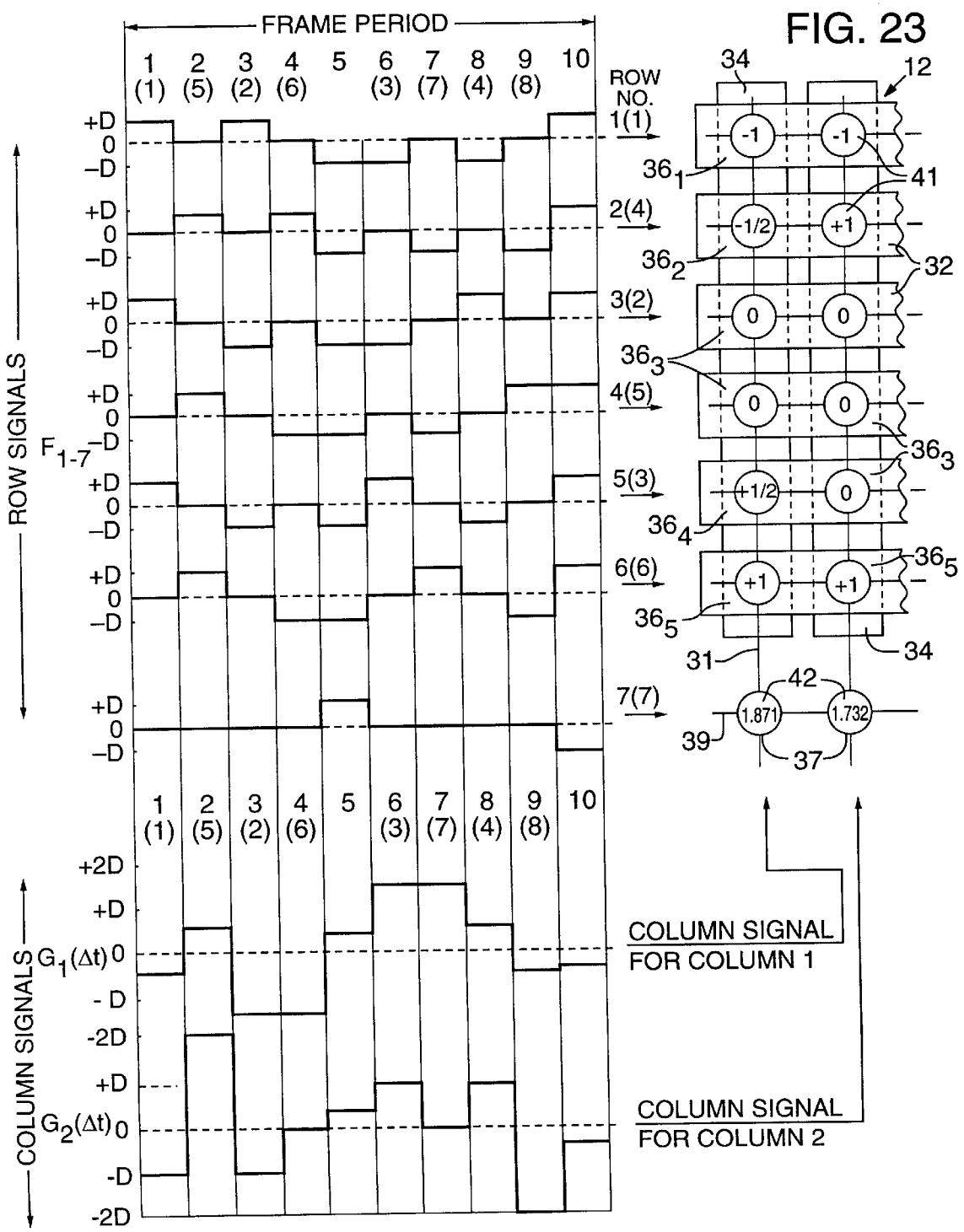
FIG. 23 is a view similar to FIG. 21 but showing a uniform voltage being applied to all the row electrodes during the non-select intervals.

In embodiments which use a low column driver voltage, the number of non-select intervals may be very large. FIG. 23 shows that one way to reduce the number of non-select intervals is to apply a uniform voltage to all of the row electrodes during the non-select interval and apply column signals of opposite polarity, so that the voltage difference across the pixels is increased. The contribution to the frame rms voltage from each non-select interval is therefore, increased and fewer non-select intervals are required to correct the frame rms voltage. The uniform voltage applied to the row electrodes are not considered to be selection pulses and the row electrodes are not considered to be selected during these non-select time intervals.

A five level row driver is may be used in an embodiment that applies a uniform voltage across all rows during non-select interval. Because the column adjustment signal depends upon the gray levels of pixels in the column, the adjustment signal may be zero during some frames. The column drivers must, therefore, be able to provide the same voltage as the row drivers during the non-select interval, so that the net voltage across such columns is zero. Because the row select voltage, D, can be significantly higher than the column drivers can achieve, it is preferable to use row drivers capable of producing five levels: plus and minus D for selecting row electrodes; zero for applying during when the row is not selected, but other rows are selected; and both polarities of a voltage approximately equal to that of the maximum column voltage, for application to all rows when adjustment column signals are applied to the column electrodes and no rows are selected.

To prevent a net DC voltage across the pixels of the display, the polarity of the constant voltage applied to the row electrodes during the non-select intervals and the polarity of the applied column signal are reversed periodically. For example, the voltages can be reversed for every non-select interval or once per frame period.

The magnitude of the column signal $G(\Delta t)$ required to correct the frame rms voltage will depend on the likely values for V, the virtual pixel element. As the number of row electrodes addressed at one time decreases, the likely values for G become smaller. If a display designer chooses to exploit the lower values of G by using less expensive, lower voltage column drivers, a corresponding larger number of non-select intervals is required. Also, the number of non-select intervals increases as the number of gray levels increases.

Figure 24:
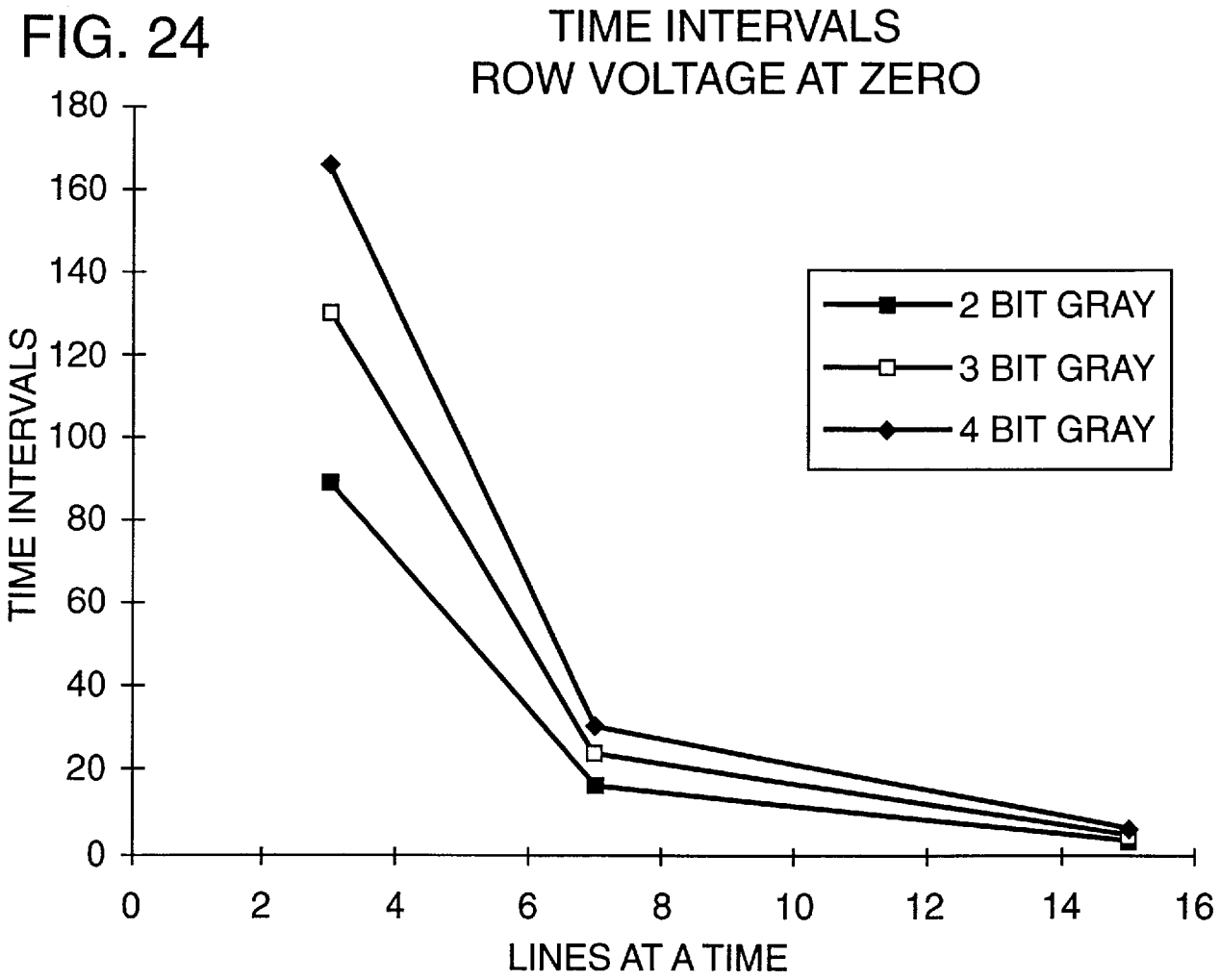
FIG. 24 is a graph showing the number of nonselect intervals required for displays addressing different numbers of rows at a time and using gray levels of different resolutions.
Figure 25:
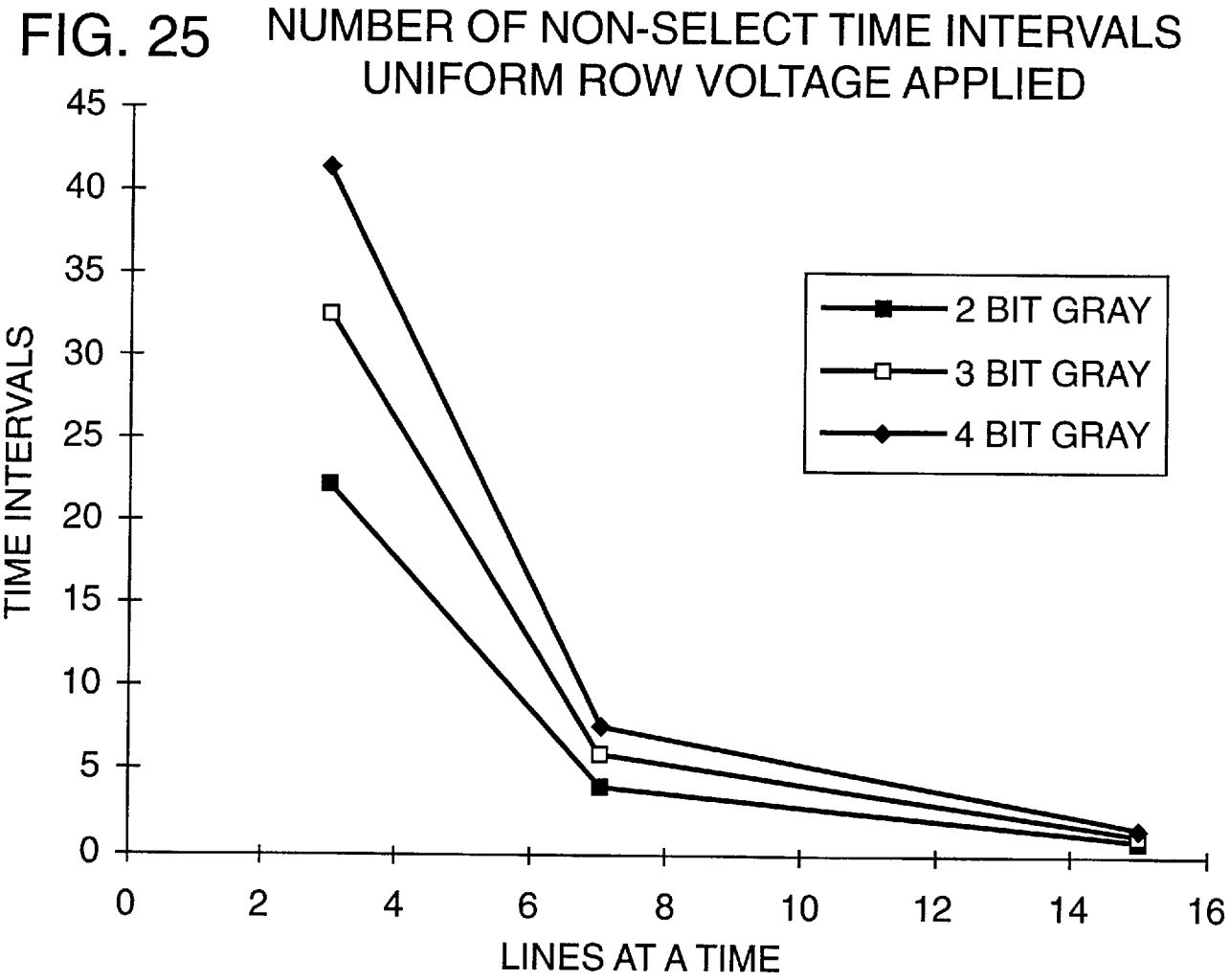
FIG. 25 is a graph similar to that of FIG. 24, but the number of non-select intervals corresponds to a display that applies a uniform voltage to all rows during non-select intervals.

FIG. 24 shows the number of non-select time intervals required for addressing schemes that select between 2 and 15 rows at a time and that display 2-, 3-, and 4-bit resolution gray levels. FIG. 25 is a graph, similar to FIG. 24, but using a display in which a uniform row voltage is applied to all rows during the non-select periods, similar to the manner shown in FIG. 23. Comparing FIG. 24 to FIG. 25 shows that the number of non-select intervals required is significantly reduced when a uniform voltage is applied to the rows to increase the rms voltage across the pixels.

In a typical embodiment, during a first characteristic time interval, row electrodes from the first sub-group are selected; during the second characteristic time interval row electrode of the second sub-group are selected; and so forth. The period of time in which each subgroup of row electrodes is selected one time is referred to as a sub-frame period.

The distribution of the non-select intervals within each sub-frame can affect image quality. If the non-select intervals were to, for example, precede time intervals in each sub-frame in which the same row electrodes were selected, an image artifact would appear on those rows. To prevent such image artifacts, the position of the non-select periods within the sub-frames is varied.

To determine a preferred scheduling of the non-select intervals, add 1 to the sum of the number of row select intervals per sub-frame and the number of non-select intervals per sub-frame to calculate a first number of time intervals. Divide the number of time intervals by the number of non-select periods per sub-frame to determine an integer.

FIG. 26 shows an example distribution of row selection signals and non-select intervals in a display having 240 row electrodes, selecting 7 rows at a time, and using 32 non-select intervals. The row addressing signals are derived from third order Walsh functions, so each row elected is selected eight times during a frame period and there are eight sub-frames. Each sub-frame will include 35 time intervals in which row electrodes are selected.The number of non-select intervals was determined as described above, and then rounded so that there is the same number of non-select intervals in each sub-frame. In FIG. 26, there are 35 select and 4 non-select intervals per sub-frame, so the first number of time intervals is 40. Dividing 40 by 4 yields the integer 10, indicating that there are groups of 10 consecutive intervals, 9 select followed by one non-select interval. This grouping is followed until all the select and non-select intervals are applied. In this case, the non-select intervals produce minimal image artifacts because each group of rows is preceded by a non-select interval approximately the same number of times in a frame period.

Apparatus Implementation

General

Figure 9:
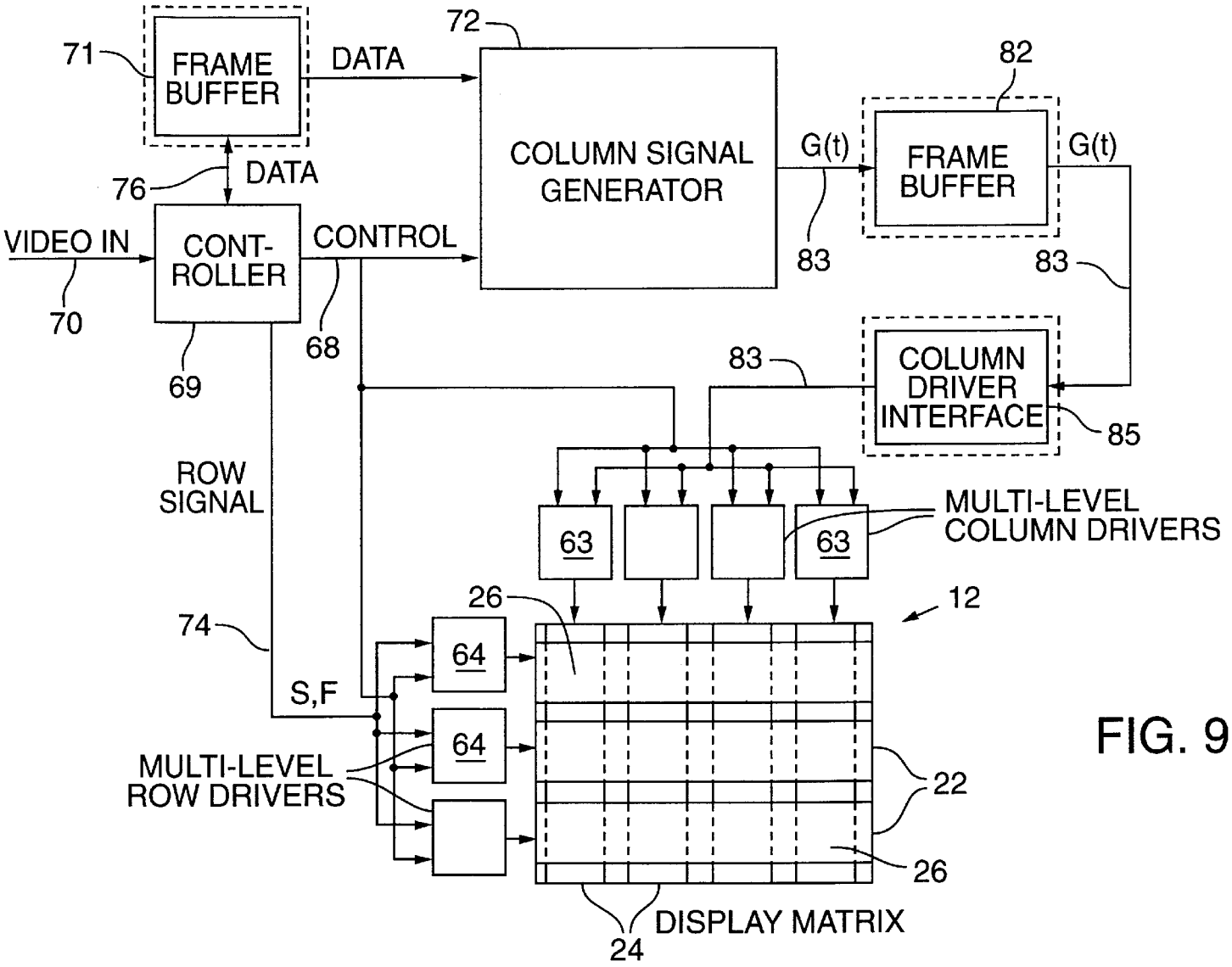
FIG. 9 is a generalized block diagram of apparatus for generating and applying signals to a passive flat panel display, such as is shown in FIG. 1, in accordance with this invention.

The pulse-height modulation method described above for providing gray level addressing may be implemented in apparatus for converting video signals into signals for addressing an LCD panel, as generally shown in FIG. 9. Video signals 70 comprising both information or data components and control or timing components are received by a controller 69. Most generally, the video signals may be either in digital representation, as is typical for a dedicated computer system, or in analog representation, as is typical for computer monitor outputs or television systems. In addition, the video signals typically are presented in a succession of horizontal or vertical rows of data, or scan lines, similar to the scan lines of a raster scanned CRT, although in a dedicated computer system, the video signals may be presented in an arbitrary progression.

Controller 69 formats the information or data components 76 and presents these components to a frame buffer 71 which receives and stores the data. Controller 69 also derives from the central components of video signals 70 control signals 68, which are presented to the other blocks in the apparatus to control the sequence of operations, including the addressing of the display panel 12.

The data stored in the frame buffer 71 is presented to a column signal generator 72 which, under direction of control signals 68, computes column signals, G(t), in accordance with the split interval-standard, split interval Swift, full interval standard, or full interval Swift modes of the method described previously. The column signals are presented to a second frame buffer 82, stored therein, and thereafter presented to a column driver interface 85, which converts them to signals compatible with multi-level column drivers 63. The column drivers 63 apply the converted column signals to the column electrodes 24 of the display matrix 12.

Meanwhile, controller 69 generates and presents row signals, S or F, to the row drivers 64 which, under direction of control signals 68 provided by the controller 69, receive the row signals and apply them to the row electrodes 22 of the display matrix 12. The row signals are independent of the data to be displayed and depend on the particular method implemented. Row signals include the block pulse functions, S, typical of standard addressing, or Swift functions, F, as described previously for Swift addressing. The coincidence of the row signals on the row electrodes and the column signals on the column electrodes cause the display matrix to display the desired gray level image represented by the information components of the video signals.

In general, the controller 69, frame buffers 71 and 82, and column signal generator 72 are comprised of digital circuitry, although analog circuitry may be used. Generally, column drivers 63 are capable of delivering at least 3 distinct levels of signals to the column electrodes, or more commonly at least 8 distinct levels, whereas the row drivers 64 are generally capable of delivering at least 2 distinct levels of signals. Depending on the particular mode of the method that is implemented, some of the blocks shown in FIG. 9 may not be necessary. For example, either or both of the frame buffers may not be necessary, as in the split and full interval, standard mode, when not implementing a split screen system.

In the general embodiment of the apparatus of this invention as well as those specific to the different modes, controller 69 (FIG. 10) is comprised of three blocks or components: data formatting 53, control and timing signal generation 54, and row signal generation 73. Data formatting block 53 receives the information or data components 76 of the video signals and presents these data to frame buffer 71. In some embodiments of the split and full interval, Swift addressing modes, the data may undergo a predetermined sequence of inversion to simplify the architecture of other parts of the apparatus. This data inversion is accounted for by the controller 69 where the row signals corresponding to the inverted data are similarly inverted.

Control and timing signal generator or block 54 receives the control and timing components of the video signals and from these derives control or timing signals 68 necessary to sequence the apparatus through the proper series of operations. Row signal generator 73 provides the proper row signal to the row drivers 64 (FIG. 9) as determined by the particular mode in which the apparatus is operated.

Figure 11:
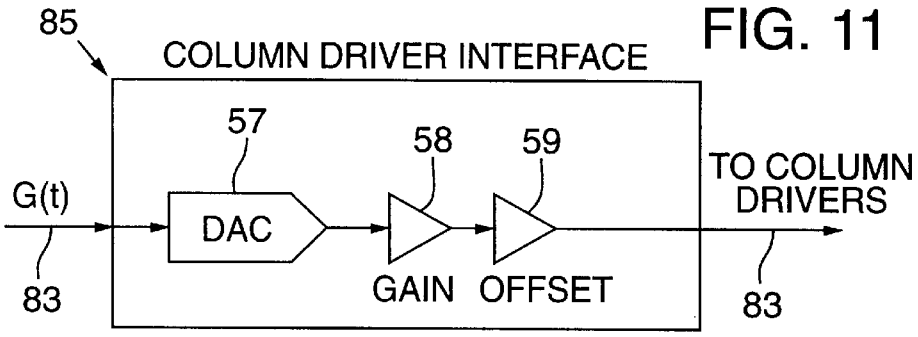
FIG. 11 is a block diagram of the column driver interface of the apparatus of FIG. 9.

In all the embodiments of the apparatus of this invention, column driver interface 85 (FIG. 11), where needed, translates the column signals, G(t), from the form in which it receives them into a form compatible with the column drivers 63. As shown in FIG. 11, typically digital column signals, G(t), from signal generator 72 are converted to analog signals by a digital-to-analog converter (DAC) 57, amplified by a gain block 58 and offset by an offsetting block 59. In some embodiments, column drivers 63 (FIG. 9) have a built-in digital interface, in which case the column signals may be directly interfaced to the column drivers. In such a case, the column driver supply voltages are selected to cause the column drivers to output scaled and offset signals represented by the digital column signals.

The representation of row 22 and column 24 electrodes in FIG. 9 is illustrative only; it will be understood that in practice the row drivers 64 and column drivers 63 each apply signals to many electrodes, respectively.

Split Interval, Standard Addressing

Figure 10:
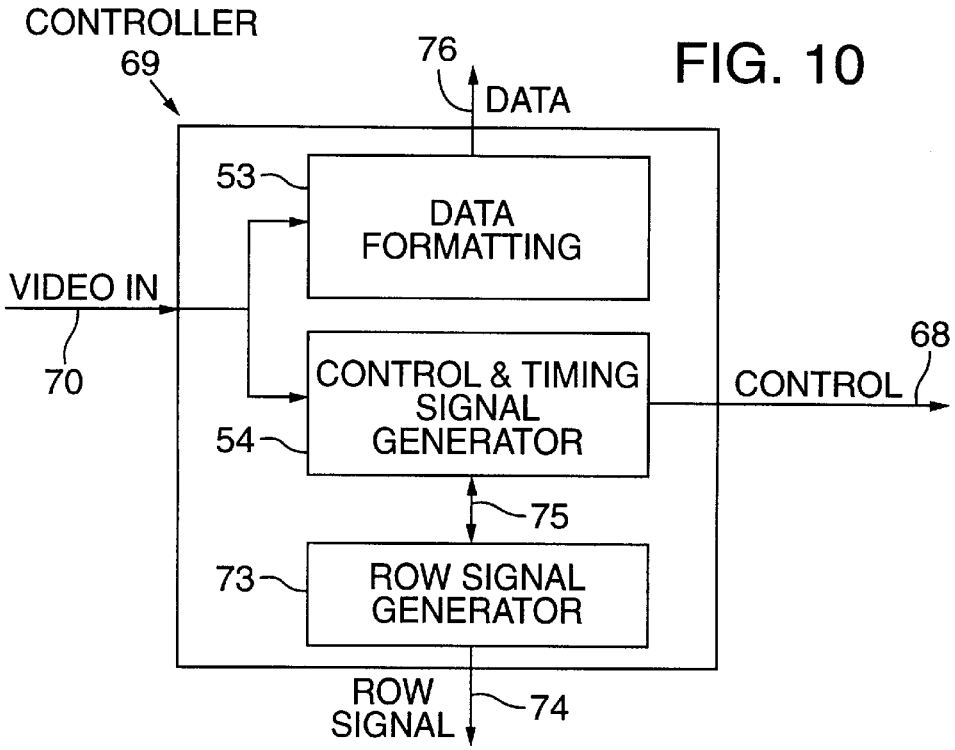
FIG. 10 is a block diagram of the controller of the apparatus of FIG. 9.
Figure 12:
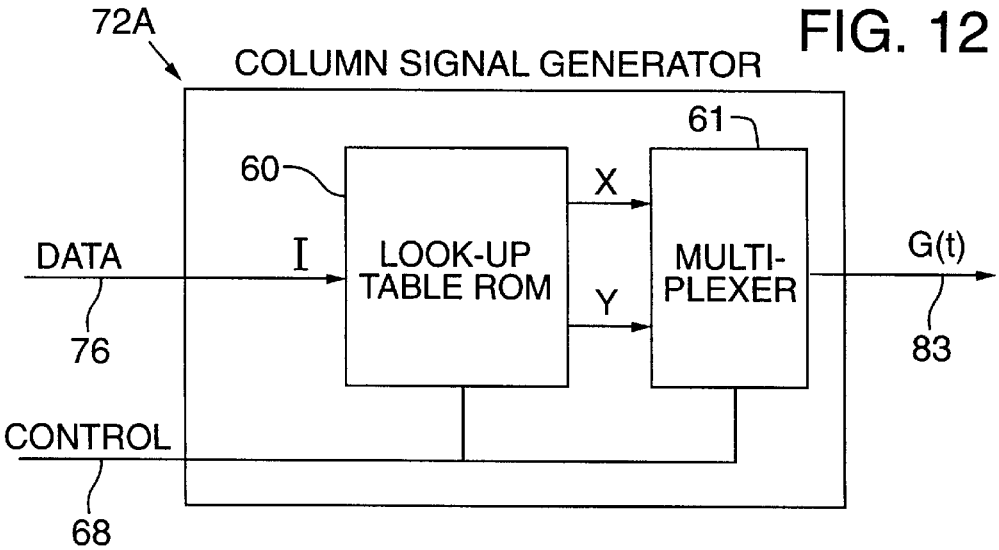
FIG. 12 is a block diagram of the column signal generator of the apparatus of FIG. 9 for operating in the split interval, standard addressing mode.

The apparatus for implementing the split interval, standard addressing mode is generally the same as described with respect to FIGS. 9–11, except for the composition of a column signal generator, designated 72A (FIG. 12).

In this embodiment, information or data components 76 of the video signal 70 are received from frame buffer 71 (or directly from the controller 69) by means for generating at least two column signals of different amplitudes or a "lookup table" (LUT) 60 (FIG. 12) in the form of a read-only memory (ROM). LUT 60 contains two precalculated X and Y values for every possible datum, calculated in accordance with the split interval, standard addressing mode previously described with respect to FIGS. 3–5. Each X value corresponds to the column signal during time subinterval $\Delta s_1$, and each Y value corresponds to the column signal during time subinterval $\Delta s_2$.

A multiplexer 61 (FIG. 12) in column signal generator 72A selects between the X and Y values during the two time subintervals and presents the resulting column signals to the inputs of multilevel column drivers 63 (FIG. 9) via connection 83. The column drivers queue the incoming signals and apply them in parallel to the column electrodes 24 of the display matrix 12.

In this embodiment, controller 69 generates the row signals in the form of the block pulse functions of height S, typical of standard addressing (FIG. 1). The row signals are presented to the inputs of row drivers 64 from controller 69, which drivers queue the row signals then apply them in parallel to the row electrodes 22 of the display matrix 12 (FIG. 9).

Under the control of timing signals 68 to LUT 60 and multiplexers 61 (FIG. 12), row drivers 64 sequentially select or strobe the row electrodes of the display matrix during each characteristic time interval $\Delta t$, while the column drivers apply the X signals during time subintervals $\Delta s_1$, and Y signals during time subinterval $\Delta s_2$. The coincidence of application of the row and column signals causes the display matrix to display the desired gray level image.

Split Interval, Swift Addressing

Figure 13:
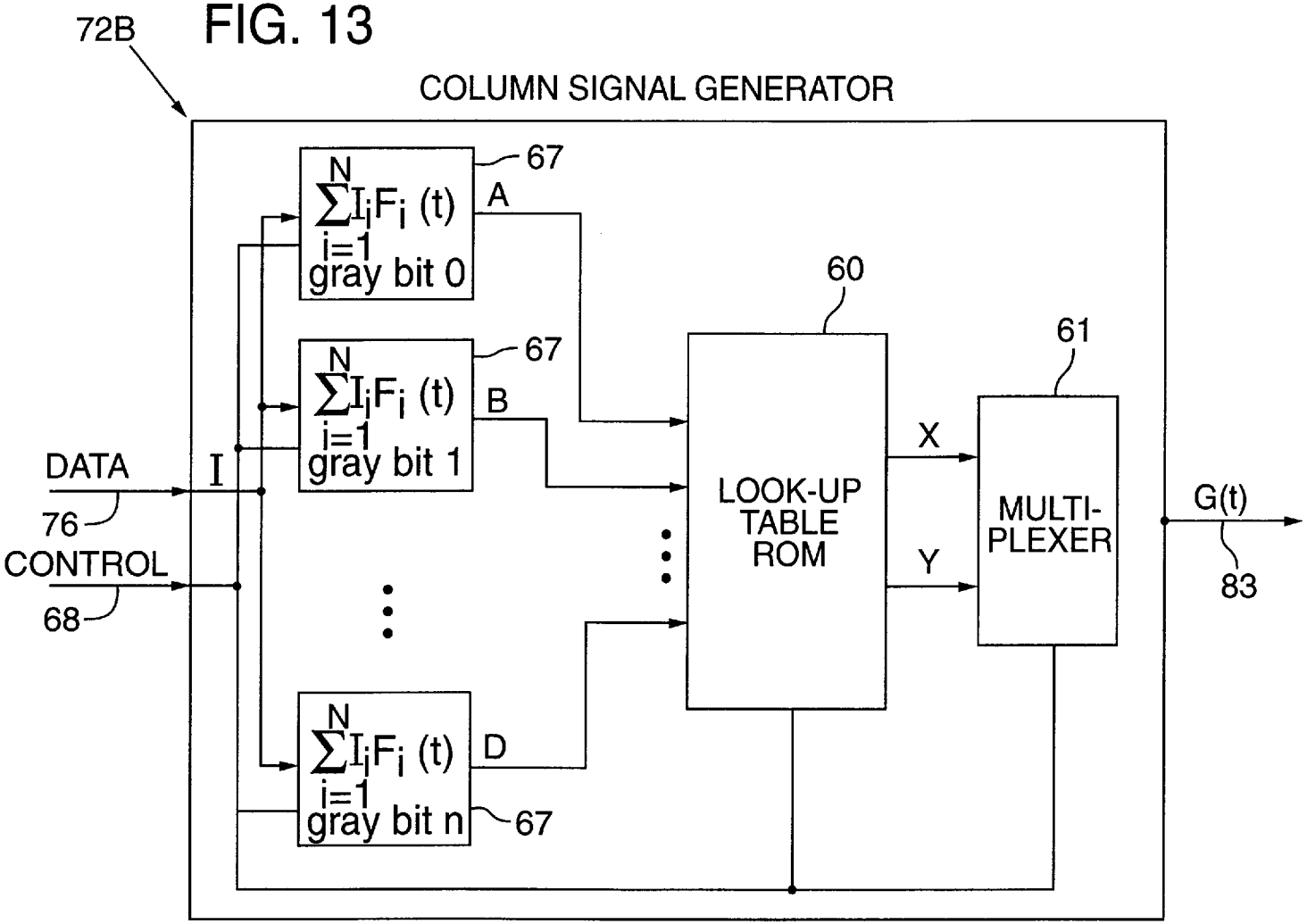
FIG. 13 is a block diagram of the column signal generator of the apparatus of FIG. 9 for operating in the split interval, Swift addressing mode.

In the apparatus for implementing the method of this invention operating in the split interval, Swift addressing mode, the column signal generator of FIG. 9 is modified as shown at 72B in FIG. 13. In this mode, it is more convenient for the information or data 76 to arrive in a succession of vertical columns or scan lines as opposed to the more conventional horizontal rows of data. Such vertical columns of data represent successive information vectors composed of information elements, I, and the conversion to vertical columns may take place in buffer 71 (FIG. 9).

The information components of the video signals 70 are routed to the data formatting block 53 (FIG. 10), which preferably performs an inversion to a predetermined selection of information or data elements, I. The data are then presented to the column signal generator 72B (FIG. 13), where they are used in accordance with the split interval, Swift addressing mode to generate column signals, G(t). Meanwhile, the row signal generator 73 of 5 controller 69 generates and presents predetermined row signals in the form of Swift functions, F, as shown in FIG. 8, to the row drivers 64 (FIG. 9) and over line 75 to the control and timing signal generator 54 (FIG. 10) to generate control signals 68 therefrom.

In this embodiment, the column signal generator 72B includes a plurality of dot product generators or blocks 67 (FIG. 13) connected to LUT 60 and multiplexer 61. Generators 67 receive and perform a dot product of the information or data elements, I, with the Swift functions, F, under the direction of control signals 68 in accordance with the Swift addressing method. Each dot product generator 67 operates on one of the bit planes zero to n, comprising the information vector of elements, I, representing the data 76 received by signal generator 72B. As a result several dot products, "A", "B", . . . , "D" are computed, one for each bit plane of each information vector. The resulting dot products, A, B, . . . , D, are used to address LUT 60 which contains for all combinations of A, B., . . . , D two precalculated values X and Y calculated in accordance with the split interval, Swift addressing mode previously described.

As was the case with the split interval, standard addressing mode, the multiplexer 61 receives the X and Y values from LUT 60, selects the X values followed by the Y values and presents the resulting column signals to the frame buffer 82 (FIG. 9) via connecting means 83. The frame buffer 82 receives and stores the column signals and presents them to the multilevel column drivers 63 (FIG. 9), which apply the X signals during time subinterval $\Delta s_1$ (FIG. 6B), and then the Y signals during time subinterval, $\Delta s_2$.

At the same time, the row drivers apply the Swift functions to the row electrodes 22 of the display matrix 12 for each characteristic time interval, $\Delta t$. As before, the coincidence of the applications of the row signals with the column signals causes the desired information from the video signal to be displayed on matrix 12.

Full Interval, Standard Addressing

Figure 14:
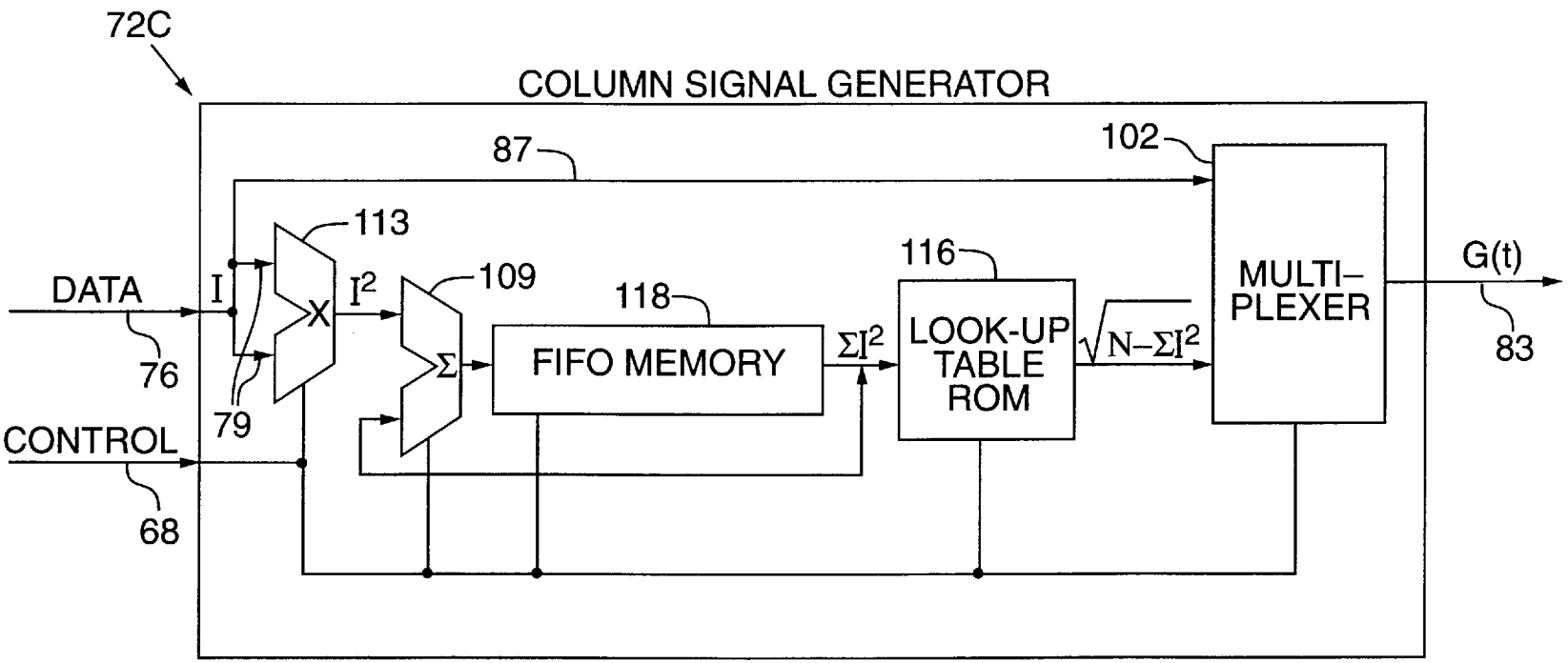
FIG. 14 is a block diagram of the column signal generator of the apparatus of FIG. 9 for operating in the full interval, standard addressing mode.

An embodiment of the apparatus for implementing the full interval, standard addressing mode is as shown in and described with respect to FIGS. 9–11 and includes the specific column signal generator 72C of FIG. 14. As described with respect to the mode illustrated in FIG. 7, this embodiment of the apparatus includes at least one additional characteristic time interval (7) and the virtual row or rows 39 with respect to which the virtual information elements 42 are generated and used to calculate an additional column signal.

In this example, the information or data is assumed to arrive in a succession of horizontal rows or scan lines as is typical of the scanning lines of a raster scanned CRT. The data 76 is received by column signal generator 72C (FIG. 14), where it follows two paths. The first path 87 presents the data to one of the inputs of a multiplexer 102, and the second path 79 presents the data to both inputs of a squaring block or multiplier 113. Multiplier 113 performs a squaring operation on the information elements, I, of the incoming rows of data and presents the squared data to one input of an adder 109. The other input of adder 109 receives previously stored, squared data from the output of a first-in, first-out (FIFO) memory 118, and the adder 109 performs a summing operation of the present data and the stored data.

The resulting sum is presented to the input of FIFO memory 118, where it is stored. As data is being received and squared the FIFO memory is shifted in such a way as to accumulate the squared data corresponding to each column of the display matrix. When all the rows of data for a frame period, T, have been processed, each location in the FIFO memory contains the sum of the squares of the information elements, I, of each column.

The FIFO memory 118 sequentially presents its contents to a square root block or lookup table (LUT) 116, which contains precalculated virtual information elements, V, corresponding to every sum of data, squared. LUT 116, in conjunction with multiplier 113, adder 109, and FIFO memory 118, all under the control of control signals 68, comprise means for generating the virtual information elements in accordance with the full interval, standard addressing mode previously described with respect to FIG. 7. LUT 116 presents the virtual information elements to the other input of multiplexer 102, which, under direction of control signals 68 from controller 69, selects between the incoming data or "real" information elements, I, and the calculated virtual information elements, V, resulting in the output to line 83 of column signals, G(t).

As was the case for the split interval, standard addressing apparatus, row signal generator 73 of controller 69 (FIGS. 9, 10) generates row signals in the form of the block pulse functions, S, typical of standard addressing. The row signals are presented to the inputs of row drivers 64, which queue the row signals and apply them to the row electrodes.

In this embodiment, row drivers 64 sequentially select or "strobe" each row 22 of the display matrix 12, while the column drivers 63 apply signals representative of the data corresponding to the selected or strobed row of the display matrix. After all the row electrodes have been strobed and during the additional time interval (7) when no "real" rows are strobed (FIG. 7), the calculated virtual information elements 42 are loaded into the column drivers 63 and applied to the column electrodes of the display matrix 12. The coincidence of the row signals applied to the row electrodes with the column signals applied to the column electrodes causes the display of the information from the video signal in the desired gray level.

Full Interval, Swift Addressing

In the apparatus embodiment of the full interval Swift addressing mode, the column signal generator 72D (FIG. 15) is incorporated with the other components of FIGS. 9–11. As was the case for the split interval, Swift apparatus (FIG. 13), it is convenient to assume that the data 76 arrives in a succession of vertical columns of data, or vertical scan lines, and that the data formatting block 53 of the controller preferably performs an inversion to a predetermined selection of information or data elements, I.

In this embodiment (FIG. 15), data 76 is received from the controller 69 (FIG. 9) and is presented to a correlation score or dot product generator or block 78, for computing a dot product, and to a multiplier-accumulator (MAC) 114. Dot product block 78 performs a dot product of the information vector represented by the information elements, I, of the incoming data with a vector comprising the value at a time $\Delta^t$ of each of the Swift functions, F, in accordance with the full interval, Swift addressing mode described with respect to FIGS. 8 and 18–23. In an embodiment, such as the one in FIG. 8 in which the adjustment voltage is applied during addressing intervals in which real rows are selected, the resulting dot products are presented via path 95 to one input of a combiner 81. In an embodiment, such as the one in FIGS. 18–23, in which the adjustment voltage is applied during a non-select interval, the resulting dot products are presented via path 95 to one input of a multiplexer 96.

MAC 114 receives the incoming data, and after all the information elements of an information vector represented by the incoming column of data have been squared and accumulated, the accumulated sum is presented to LUT 116. As was the case for the full interval, standard addressing apparatus of FIG. 14, LUT 116 contains precalculated virtual information elements for every sum of data squared. The precalculated virtual information elements may include a correction factor for the frequency dependence of the display, as described above. The combination of the LUT 116 and the MAC 114 provides an adjustment term generator 80 (FIG. 15) which performs the calculation of the value V of the virtual information elements 42 in accordance with the full interval, Swift addressing mode of FIG. 8. LUT 116 of generator 72D presents the calculated virtual information element or adjustment term to the other input of combiner 81. If the adjustment is to be applied over more than one addressing interval, the value determined from LUT 116 will be adjusted accordingly to maintain the appropriate adjustment rms voltage over a frame period.

Figure 27:
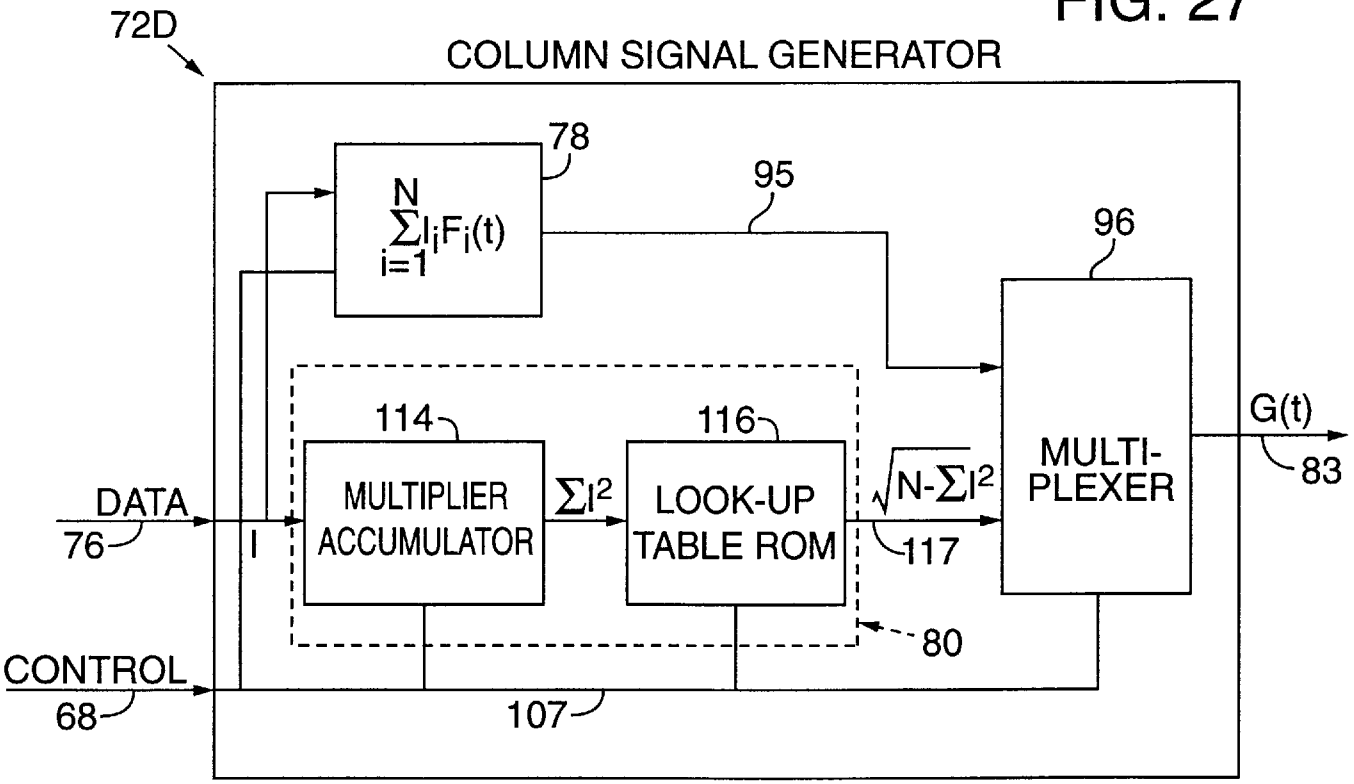
FIG. 27 is a block diagram of the column signal generator, similar to the one shown in FIG. 15, but for use in an embodiment in which adjustment signals are applied to the columns during non-select intervals.

Under direction of control signals 68 from controller 69 via path 107, combiner 81 adds the adjustment term to the dot product term signal generated in the dot product generator 78, or multiplexer 96 (FIG. 27) switches between the adjustment term and the dot product term.

The combined dot product and virtual information element or adjustment term form the column signals, G(Δt), are presented by combiner 81 to frame buffer 82 (FIG. 9), where they are stored. Under direction of controller 69, frame buffer 82 presents these signals to the multilevel column drivers 63, which queue the incoming signals and apply them in parallel to the column electrodes 24 of the display matrix 12.

As was the case for the split interval, Swift addressing apparatus of FIG. 13, row signal generator 73 of controller 69 generates predetermined row signals in the form of the Swift functions, F (FIG. 8), typical of Swift addressing. The row signals are presented to the inputs of row drivers 64, which queue the row signals and apply them in parallel to the row electrodes 22 of the display matrix 12 coincidental with the application of the column signals to the column electrodes. Thus the display matrix 12 is caused to display the desired gray scale image represented by the information of the video signal.

In both the split and full interval, Swift addressing apparatus descriptions, use is made of a "dot product" generator or calculation block to perform a dot product of the information vectors, I, with the Swift functions, F. The specific embodiment of the dot product calculation may take many forms. For example, if Walsh function-based Swift functions are used, one skilled in the art will recognize that the dot product is in fact a Walsh transform operation for which much electronic hardware has been developed. Alternatively, the dot product may be performed as a correlation of the information vector with the Swift function, or by using adder and subtractor hardware.

In the more specific example of the full interval, Swift apparatus, hereinafter described with respect to FIGS. 16, 17, display 12 is considered to include 480 rows and 640 columns forming 307,200 pixels. As is common practice, the display may be divided into upper and lower sections of 240 rows each and simultaneously addressed to provide a high selection ratio. In this example the number of multiplexed rows, N, of the display is assumed to be 240.

For this example it will also be assumed that the pixel information elements, I, have 64 gray shades or levels, i.e., $2^n$, where n is the number of gray bits or planes of the information vector, in this example, n=6. It will also be assumed that the Swift functions, $F_i$, are bi-level and almost cyclic, and have elements which are either +D or −D (FIG. 8). For purposes of simplifying the processing thereof, elements of both the information vectors and the Swift functions may be transformed into digital representations: each information element, I, being a binary integer from 0 to 63, and each Swift function, $F_i$, into time dependent elements $R_i(t)$ having values of one to represent −D and zero to represent +D.

In this specific example, the dot product term of G(t) for each column is performed as a correlation of the information vector with Swift function vectors defined by elements $R_i(t)$ of the set of Swift functions $F_i$ to $F_{240}$ at a particular time t. With the binary transformation of the information elements and the Swift functions, the dot product term becomes:

$$\frac{D}{\sqrt{240}}\ \frac{1}{31.5}\sum_{i=1}^{240}\left[\sum_{g=0}^{5}\left[2^g(I_{ig}\oplus R_i(t))\right]-31.5\right]$$

where ⊕ indicates the logical exclusive-or function and $I_{is}$ is the gth bit plane of the information element $I_i$. The adjustment term for each column is given by:

$$\frac{D}{\sqrt{240}}\ \frac{1}{31.5}\left([2R_{241}(t)-1]\sqrt{\sum_{i=1}^{240}63I_i-\sum_{i=1}^{240}I_i^2}\right.$$

and this example is based on one virtual information element and one corresponding virtual row.

The data components of video signals 70 (FIG. 9) arrive in horizontal lines of data composed of pixel information elements, I, including the desired gray levels for each pixel, and are stored in frame buffer 71 in the form of a matrix 31 corresponding to the matrix of pixels in display panel 12 (See FIGS. 7 and 8). The column signal generator 72 (FIG. 9) receives the pixel information elements from storage means 71 in form of vertical lines of information elements and generates column signals, G, therefrom.

Figure 15:
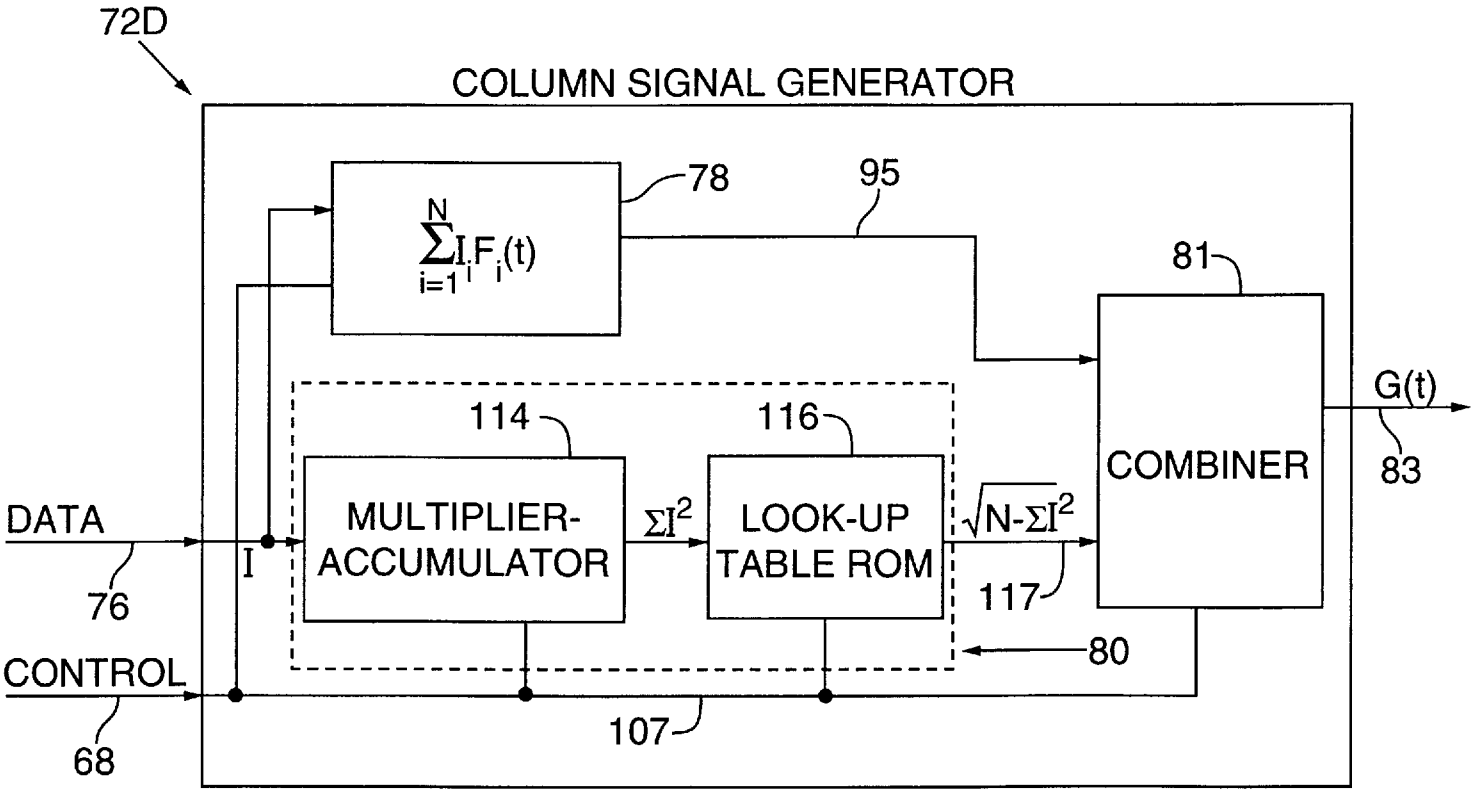
FIG. 15 is a block diagram of the column signal generator of the apparatus of FIG. 9 for operating in the full interval, Swift addressing mode.
Figure 16:
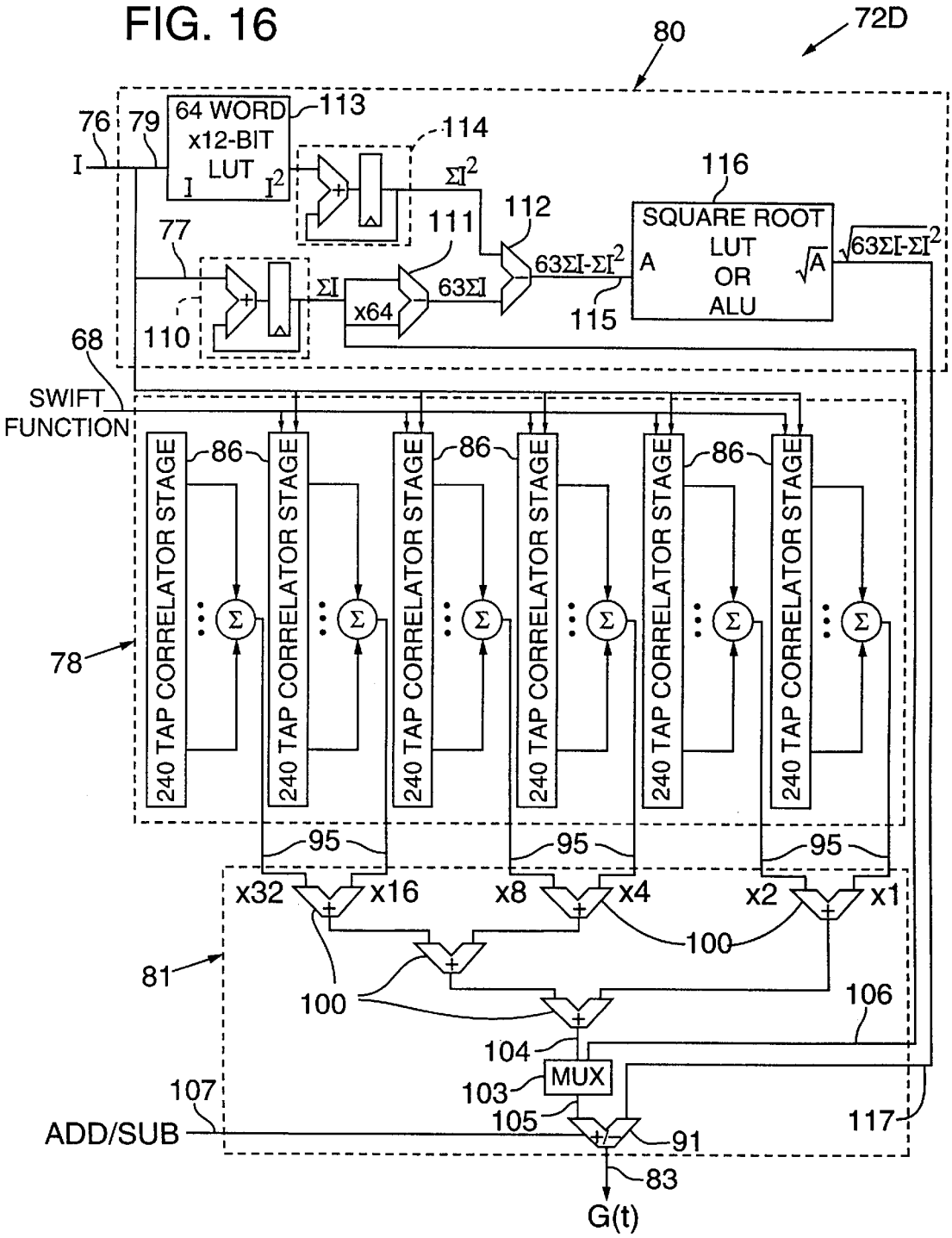
FIG. 16 is a more detailed block diagram and schematic representation of the dot product generator, adjustment term generator and combiner of the column signal generator of FIG. 15.
Figure 17:
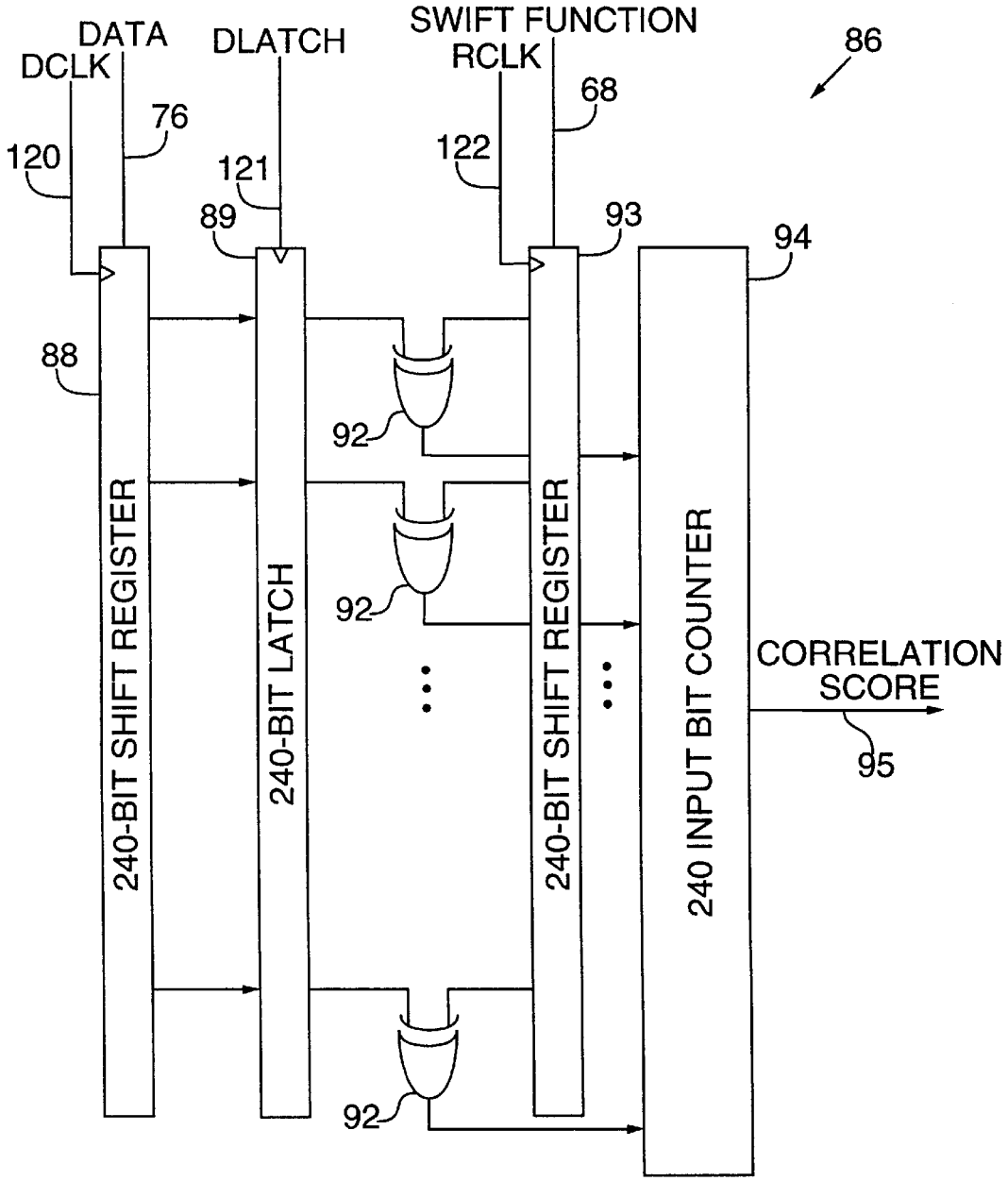
FIG. 17 is a more detailed block diagram and schematic representation of a correlation stage of the dot product generator of FIG. 16.

In the specific form of column signal generator 72D (FIGS. 15 and 16), dot product generator 78 comprises six correlation stages, each generally designated 86 (FIG. 16). Each bit plane of the six-bit information elements making up the information vectors is routed to a dedicated correlation stage. Each correlation stage 86 (FIG. 17) is comprised of a 240-bit data register 88, a 240-bit data latch 89, 240 exclusive-or (XOR) gates 92, a 240-bit reference register 93, and a 240-input bit counter 94.

The data (one bit plane of the six-bit information vector) is presented via path 76 to the input of each data register 88, where it is sequentially loaded by a register data clock signal, DCLK, 120. After one information vector is loaded into the data register 88, it is transferred to data latch 89 by clock signal, DLATCH, 121, leaving data register 88 free to receive the next information vector. Both clock signals DCLK and DLATCH are provided from a control component from controller 69 via path 68. The 240 outputs of each data latch 89 are presented to one of the inputs of the 240 XOR gates 92.

The 240-bit reference register 93 of each correlation stage 86 is sequentially loaded via line 68 (FIG. 16) with reference Swift functions from controller 69 using reference clock signal, RCLK, 122, provided by controller 69 via path 68.

The 240 outputs of the reference registers 93 (FIG. 17) are presented to the other inputs of the 240 XOR gates 92. When the first Swift function vector is loaded into reference registers 93, the 240 XOR gates 92 compare each pixel information element, I, in data latch 89 with each corresponding Swift function element, F. The outputs of the XOR gates 92 are presented to 240-input bit counter 94, which counts the number of logic high bits present at its 240 inputs and encodes this number as an eight-bit binary word which is presented via path 95 to combiner 81 (FIGS. 15 and 16). This eight-bit word is referred to as a "correlation score" between the information vector and the Swift function vector.

For every information vector latched in data latch 89 (FIG. 17), 255 Swift function vectors are loaded into each reference register 93, resulting in 255 correlation scores between the information vector and the 255 Swift function vectors. In this example, the Swift functions are almost cyclic, which allows the 255 Swift functions to be loaded with as few as 255 RCLK pulses (because each RCLK pulse cyclically shifts the previous Swift function vector by one, resulting in the next Swift function vector).

The 256th correlation score is the dot product of the information vector and a constant Swift function vector and is calculated simply by summing the elements of the information vector. This is performed by an accumulator 110 in association with adjustment term generator 80 (FIGS. 15 and 16). Data is presented to the accumulator 110, which accumulates the information elements of the information vector resulting in the 256th correlation score, which is presented to combiner 81.

The adjustment term generator 80 (FIGS. 15, 27, and 16) receives data signals 76 from frame buffer 71 via paths 77 and 79 and computes the adjustment term therefrom. From path 77 (FIG. 16) the data is converted by accumulator 110 into a base summation, which is also the last correlation score.

The base summation is also multiplied by 63 by a simple left shift of 6 places (×64), in conjunction with a subtractor 111, and is then fed to a subtractor 112.

From path 79 the data is processed through squaring block 113 (FIGS. 14 and 16) followed by an accumulator 114 and thence to subtractor 112 where the results are combined with those from path 77.

The combined result is presented to the input 115 of square root block 116 which results in the derivation of the final adjustment term. From square root block 116 the adjustment term is presented to combiner 81 via line 117 (FIGS. 15 and 16), which combines the adjustment term with the correlation scores from generator 78 and results in the desired column signals, G. In an embodiment in which the adjustment voltage is applied in non-select intervals multiplexer 96 replaces combiner 81, because one of the two terms is always zero.

Combiner 81 or multiplexer 96 receives the correlation scores from the six correlation stages 86 of dot product generator 78 and the 256th correlation score and the adjustment term from adjustment term generator 80 and combines or multiplexes them to result in the column signals. Combiner 81 (FIG. 16) or multiplexer 96 binary weights and sums the correlation scores from the six correlator stages 86. The weighting is accomplished by a left shift of 0, 1, . . . , 5 of the correlation scores from the least—to the most-significant correlation stages, respectively. Adders 100 add the weighted correlation scores and present the total to one input of a multiplexer 103 via connection 104. The other input of multiplexer 103 receives the 256th correlation score from adjustment term generator 80 via line 106.

Multiplexer 103 selects between the 255 summed correlation scores generated by the dot product generator 78 and the 256th correlation score generated by the adjustment term generator 80 and presents all 256 correlation scores via line 105 to one input of an adder/subtractor 91 (FIG. 16). The other input of adder/subtractor provides the adjustment term which it adds to or subtracts from the correlation scores in response to a control signal 107 (FIG. 15) supplied by controller 69. Control signal 107 is generated by controller 69 based on the virtual row of the Swift functions.

From combiner 81 (FIG. 16) or multiplexer 96, the adjusted column signals, G, are received in frame buffer 82 via line 84 (FIG. 9). If the signals are processed as digitally encoded signals and the column drivers 63 are of the analog input type, the column signal must first be processed through a digital-to-analog converter 57 (FIG. 11).

The pulse-height modulation method and apparatus of this invention require multilevel LCD column drivers. In general, the number of simultaneously accessible voltages required of the column drivers at any one time depends on the particular mode of addressing implemented, the number of gray levels to be displayed, and the accuracy of image portrayal required in the application. In practice, currently available multilevel drivers used for pulse-height modulation addressing fall into two categories: digital input type (such as the Hitachi HD66310) which are suitable for applications requiring up to 64 simultaneously accessible voltages, and analog input type (such as the Seiko Epson SED1770) which are suitable for applications requiring in excess of 256 simultaneously accessible voltages. In general, the split interval, standard addressing mode requires fewer simultaneously accessible voltages than the other modes and can require as few as M simultaneously accessible voltages for displaying M gray levels.

Column signals, G, presented to the inputs of drivers 63, are queued by the drivers in internal sample-and-hold registers. When all the samples are loaded for a particular time interval, the drivers apply all the samples to the corresponding column electrodes of the display 12 through the driver outputs simultaneously as regulated by control signals from controller 69. While the present samples are being applied to the electrodes, the next set of samples are queued into the drivers for the next time interval. This process repeats for all 256 time intervals of this example, at which time a new frame cycle begins.

The row drivers 64 apply the Swift functions, F, received via line 74 from row signal generator 73 of controller 69 to the row electrodes of the display in synchronicity with the signals applied to the column electrodes by the column drivers 63. The row drivers may be of the bi-level digital type similar to the SED1704 model available from Seiko Epson Corporation of Japan. The Swift functions are queued by drivers 64 in shift registers internal to the drivers. After each Swift function vector is loaded, the drivers apply those signals simultaneously to the row electrodes through the driver outputs. The timing of the row driver outputs corresponds to the timing of the column driver outputs so that both the row drivers and column drivers apply their outputs simultaneously, per control signals from controller 69.

Figure 28:
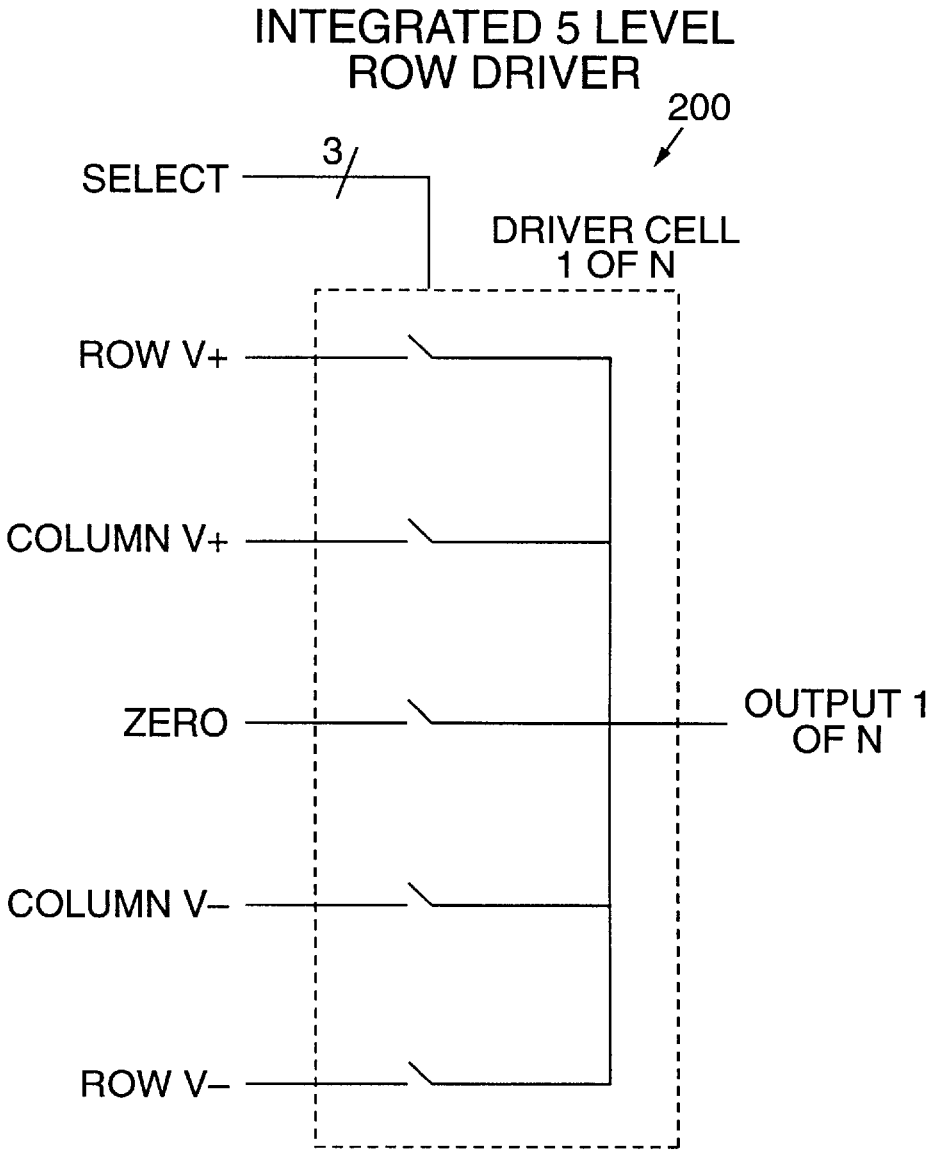
FIG. 28 is a schematic showing a five level row driver that can be used to implement an embodiment such as that shown in FIG. 23.

In an embodiment such as the one shown in FIG. 23, a uniform row signal is applied to all rows during non-select intervals. Because the display should be able to apply a zero voltage during a non-select interval, the uniform row voltage applied must be within the range of the column drivers, so that a net voltage of zero can be applied across the pixels in a column. In many embodiments, however, the magnitude D of the row signals is higher than that of the maximum column voltage magnitude. Two additional voltage levels, therefore, of opposite polarities, are added to the row driver. FIG. 28 shows a preferred five-level row driver 200.

Figure 29:
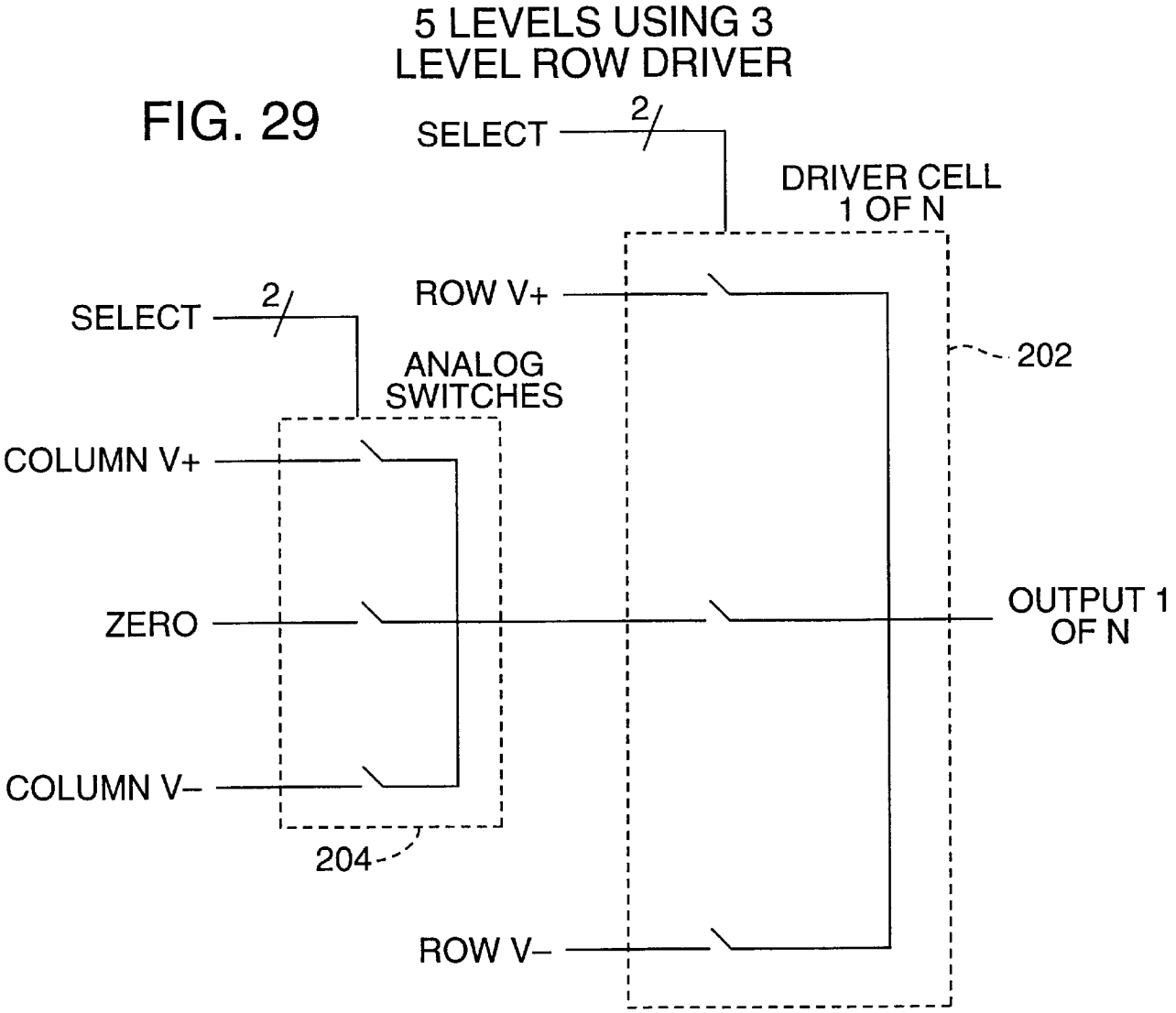
FIG. 29 is a schematic showing the use of a three level driver using multiple inputs to produce a five level output that can be used to implement an embodiment such as that shown in FIG. 23.

In an embodiment such as the one shown in FIG. 23 a uniform row signal is applied to all rows during non-select intervals. Because the display should be able to apply a zero voltage during a non-select interval, the row voltage applied must be within the range of the column drivers, so that a net voltage of zero can be applied in a column. In many embodiments, however, the magnitude of the row signals is higher than that of the maximum column voltage magnitude. Two additional voltage levels, therefore, of opposite polarities, must be provided by the row driver. FIG. 28 is a schematic showing a five-level row driver 200 that can be used. FIG. 29 is a schematic showing the use of a three level row driver 202, with the center voltage being externally switchable by an analog switch 204 between zero and two additional voltage levels that are similar to the voltage capabilities of the column drivers, to produce the effect of a five level row driver.

Where lookup tables (LUT) have been referred to herein (FIGS. 12–16) those skilled in the art will recognize that electronic hardware such as arithmetic logic units (ALU) exists which can perform the required calculations according to the applicable equations at the appropriate times.

We claim:

1. A method for addressing a display in which multiple overlapping first and second electrodes positioned on opposite sides of an rms-responding material define an array of pixels that display information in more than two gray levels, each pixel having in a frame period a desired gray level that is represented by a pixel information element having a value between a lower limit and an upper limit, the pixels characterized by optical states that depend on values of rms voltages established across the pixels, the method comprising:

applying first signals to cause selections of corresponding first electrodes during characteristic time intervals of the frame period, at least some of the first signals causing selections of said corresponding first electrodes during more than one of the characteristic time intervals of the frame period;

generating second signals of changing magnitudes and applying them to corresponding second electrodes during plural time intervals, at least some of which correspond to the characteristic time intervals, of the frame period, the magnitude of each of the second signals during at least some of the characteristic time intervals being chosen from more than two available voltage levels and dependent upon pixel information element values of pixels defined by said corresponding second electrode and selected first electrodes and the magnitude of each of said second signals during at least one time interval when no first electrode is selected, a non-select period, being chosen to produce over a frame period an optical response such that the second signals applied to different ones of the second electrodes during a frame period produce a uniform brightness of pixels that are defined by different ones of the second electrodes and that have the same pixel information element values.

2. The method of claim 1 in which the magnitude of each second signal during the non-select period produces over a frame period substantially the same second electrode rms voltage, the rms voltages over a frame period differing among the second signals by an amount up to approximately that required to compensate for the frequency dependence of the optical response of the liquid crystal material.

3. The method of claim 1 in which the magnitude of each second signal during the non-select period is determined by pixel information element values of at least some of the pixels defined by the corresponding second electrode.

4. The method of claim 3 in which the frame period includes multiple non-select time periods and in which the magnitude of each second signal during each of the non-select time periods is determined by the pixel information element values of subsets of the pixels defined by the corresponding second electrode, the subsets of pixels being different for different ones of the multiple time periods.

5. The method of claim 1 in which generating second signals includes determining a deviation from a uniform column signal rms for each second signal and choosing a magnitude for each second signal during at least one non-select time period to adjust for the deviation.

6. The method of claim 5 in which a single deviation corresponding to an entire frame period is determined for each column signal.

7. The method of claim 5 in which deviations corresponding to portions of the frame period are determined for each column signal.

8. The method of claim 7 in which the multiple non-select time periods are distributed throughout the frame period.

9. The method of claim 1 in which each frame period includes multiple non-select time periods.

10. The method of claim 1 in which the first signals simultaneously select a subset of the first electrodes, and in which the magnitude of each second signal during a non-select time period is determined from the pixel information element values of the pixels defined by the corresponding second electrode and the subset.

11. The method of claim 10 in which the first signals simultaneously select the first electrodes in each subset during multiple characteristic time periods distributed throughout the frame period.

12. The method of claim 11 in which a non-select time period is associated with each subset a time period the non-select time periods associated with different ones of the subgroups being distributed throughout the frame period.

13. The method of claim 12 in which applying first signals includes applying an offset voltage to the first electrodes during a non-select interval.

14. The method of claim 13 in which the same offset voltage is applied to all the first electrodes during a non-select interval.

15. A method for addressing a display in which multiple overlapping first and second electrodes positioned on opposite sides of an rms-responding material define an array of pixels that display information in more than two gray levels, each pixel having in a frame period a desired gray level that is represented by a pixel information element having a value between a lower limit and an upper limit, the pixels characterized by optical states that depend on values of rms voltages established across the pixels, the method comprising:

applying first signals to cause selections of corresponding first electrodes during characteristic time intervals, at least some of the first signals causing selections of said corresponding first electrodes during more than one of the characteristic time intervals of the frame period, the frame period including non-select time intervals in which none of the first electrodes is selected and each of the first electrodes is maintained at the same voltage level, the non-select time intervals being distributed over the frame period;

generating second signals of changing magnitudes and applying them to corresponding second electrodes during the frame period, the magnitude of each second signal during at least some of the characteristic time intervals being chosen from more than two available voltage levels and dependent upon pixel information element values of pixels defined by said corresponding second electrode and selected first electrodes and the magnitude of each of said second signals during the non-select intervals chosen to produce over a frame period a uniform brightness of pixels defined by different ones of the second electrodes and having the same pixel information element values.

16. A method for addressing a display in which multiple overlapping first and second electrodes positioned on opposite sides of an rms-responding material define an array of pixels that display information in more than two gray levels, the pixels having in a frame period desired gray levels that are represented by pixel information elements having values between a lower limit and an upper limit, the pixels characterized by optical states that depend on values of rms voltages established across the pixels, the method comprising:

determining at least one virtual first signal for at least one virtual first electrode that overlaps the second electrodes and provides a plurality of virtual pixels having desired gray levels represented by virtual pixel information elements having values, the value of each virtual pixel information element being determined by the pixel information element of at least one pixel information element defined by the corresponding second electrode;

applying first signals to select corresponding first electrodes during characteristic time intervals of the frame period; and generating second signals of changing magnitudes and applying them to corresponding second electrodes during plural time intervals, at least some of which correspond to the characteristic time intervals, within the frame period, the magnitude of each second signal being selected during some of the characteristic time intervals within the frame period from more than two available voltages and being determined from the pixel information element of each pixel defined by selected first electrodes and said corresponding second electrode and, during time periods within the frame when none of the first electrode are selected, the second signal being determined by a virtual pixel information element of a virtual pixel determined by a selected virtual row electrode and the corresponding second electrode.

17. The method of claim 16 in which:

determining at least one virtual first signal for at least one virtual first electrode includes determining a single virtual row signal for a single virtual row; and the value of each virtual pixel information element is determined by the values of the pixel information elements of all the pixels defined by the corresponding second electrode.

18. The method of claim 17 in which generating second signals includes generating a second signals during multiple time periods in which none of the first electrodes is selected, the cumulative rms voltage of the multiple time periods being determined by the corresponding virtual pixel information value and the corresponding virtual first signal.

19. The method of claim 16 in which:

determining at least one virtual first signal for at least one virtual first electrode includes determining multiple virtual row signals for a multiple virtual rows; and the value of each virtual pixel information element is determined by the values of the pixel information elements of different ones of the pixels defined by the corresponding second electrode.

20. The method of claim 16 in which the magnitude of each second signal during non-select intervals is related to a virtual pixel information element value, V, determined by:

$$V = \pm\sqrt{N - \sum_{i=1}^{N} I_i^2} \quad ,$$

where V is the value of the virtual pixel information element, N is the number of rows in the display, and $I_i$ is the value of the pixel information element of the i-th real row, i being an integer from 1 to N.

21. The method of claim 20 in which the value of the virtual pixel information element is determined by multiplying the virtual pixel information element value by a magnitude of a virtual first signal.

22. The method of claim 20 in which the value of the virtual pixel information element is adjusted by a correction factor determined by the frequency components of the virtual first signal to compensate for the varying optical response of the liquid crystal to the different frequency addressing signals.

* * * * *